US009139399B2

(12) United States Patent
Hidaka et al.

(10) Patent No.: US 9,139,399 B2
(45) Date of Patent: Sep. 22, 2015

(54) SHEET PROCESSING APPARATUS AND IMAGE FORMING SYSTEM

(71) Applicants: Makoto Hidaka, Tokyo (JP); Takuya Sano, Kanagawa (JP); Takao Watanabe, Kanagawa (JP); Satoshi Saito, Kanagawa (JP); Shohichi Satoh, Kanagawa (JP); Tomomichi Hoshino, Kanagawa (JP); Atsushi Kikuchi, Kanagawa (JP); Kiyoshi Hata, Tokyo (JP); Keisuke Sugiyama, Tokyo (JP)

(72) Inventors: Makoto Hidaka, Tokyo (JP); Takuya Sano, Kanagawa (JP); Takao Watanabe, Kanagawa (JP); Satoshi Saito, Kanagawa (JP); Shohichi Satoh, Kanagawa (JP); Tomomichi Hoshino, Kanagawa (JP); Atsushi Kikuchi, Kanagawa (JP); Kiyoshi Hata, Tokyo (JP); Keisuke Sugiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/154,580

(22) Filed: Jan. 14, 2014

(65) Prior Publication Data

US 2014/0206518 A1 Jul. 24, 2014

(30) Foreign Application Priority Data

Jan. 18, 2013 (JP) ..... 2013-007618

(51) Int. Cl.

| | |
|---|---|
| ***B65H 45/18*** | (2006.01) |
| ***B31F 1/00*** | (2006.01) |
| ***B65H 45/12*** | (2006.01) |
| ***B65H 45/04*** | (2006.01) |
| ***B65H 37/04*** | (2006.01) |

(52) U.S. Cl.

CPC *B65H 45/18* (2013.01); *B31F 1/00* (2013.01); *B31F 1/0006* (2013.01); *B31F 1/0035* (2013.01); *B65H 37/04* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search

CPC ..... B31F 1/00; B31F 1/0006; B31F 1/0035; B65H 45/12; B65H 45/04; B65H 2801/27

USPC ..... 270/32, 45, 58.07

See application file for complete search history.

(56) References Cited

U.S. PATENT DOCUMENTS 5,520,604 A * 5/1996 Reist ..... 493/422
8,002,255 B2 * 8/2011 Kawaguchi et al. ..... 270/45

(Continued)

FOREIGN PATENT DOCUMENTS

EP 2634125 A1 * 9/2013
EP 2644547 A1 * 10/2013

(Continued)

*Primary Examiner* — Leslie A Nicholson, III

(74) *Attorney, Agent, or Firm* — Harness, Dickey & Pierce, P.L.C.

(57) ABSTRACT

A sheet processing apparatus comprises a pressurizing unit including a first pressurizing member and a second pressurizing member; and a moving unit moving the pressurizing unit and including a driving motor, wherein the position where a sheet bundle is pressurized by the first pressurizing member and the position where the sheet bundle is pressurized by the second pressurizing member are shifted in the direction of the fold line of the sheet bundle, and a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member.

12 Claims, 27 Drawing Sheets

(56) References Cited

U.S. PATENT DOCUMENTS

| | | | | |
|---|---|---|---|---|
| 8,342,497 | B2 * | 1/2013 | Abe | 270/45 |
| 2003/0151187 | A1 | 8/2003 | Suzuki et al. | |
| 2003/0219295 | A1 | 11/2003 | Saitoh et al. | |
| 2003/0234487 | A1 | 12/2003 | Tamura et al. | |
| 2004/0070133 | A1 | 4/2004 | Yamada et al. | |
| 2004/0104525 | A1 | 6/2004 | Suzuki et al. | |
| 2008/0315481 | A1 | 12/2008 | Iguchi et al. | |
| 2008/0315482 | A1 | 12/2008 | Iguchi et al. | |
| 2008/0315483 | A1 | 12/2008 | Iguchi et al. | |
| 2008/0315484 | A1 | 12/2008 | Iguchi et al. | |
| 2008/0315485 | A1 | 12/2008 | Iguchi et al. | |
| 2008/0315486 | A1 | 12/2008 | Iguchi et al. | |
| 2008/0315487 | A1 | 12/2008 | Iguchi et al. | |
| 2008/0315488 | A1 | 12/2008 | Iguchi et al. | |
| 2009/0036287 | A1 | 2/2009 | Kawaguchi et al. | |
| 2009/0200725 | A1 | 8/2009 | Tamura et al. | |
| 2010/0219575 | A1 | 9/2010 | Iguchi et al. | |
| 2011/0057375 | A1 | 3/2011 | Iguchi et al. | |
| 2011/0156333 | A1 | 6/2011 | Iguchi et al. | |
| 2011/0176849 | A1 * | 7/2011 | Abe | 399/408 |
| 2011/0181917 | A1 | 7/2011 | Iguchi et al. | |
| 2011/0278784 | A1 | 11/2011 | Iguchi et al. | |
| 2012/0190526 | A1 | 7/2012 | Terao | |

FOREIGN PATENT DOCUMENTS

| | | |
|---|---|---|
| JP | 08-123284 | 5/1996 |
| JP | 2009-029625 | 2/2009 |
| JP | 2012-020882 | 2/2012 |
| JP | 2012-153530 | 8/2012 |

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-007618 filed in Japan on Jan. 18, 2013.

BACKGROUND OF THE INVENTION

1. Field of the Invention

The present invention relates to a sheet processing apparatus performing predetermined processing on a sheet and an image forming system including the sheet processing apparatus.

2. Description of the Related Art

Known as this kind of sheet processing apparatuses are ones that perform folding processing on sheets after subjected to image forming processing performed by image forming apparatuses. Japanese Patent Application Laid-open No. 2012-20882 discloses a sheet processing apparatus including a folding plate that presses with an end thereof a folded position on a sheet surface of a sheet bundle consisting of a plurality of sheets in the direction perpendicular to the sheet surface and a pair of folding rollers disposed so as to oppose to each other with a movement path of the folding plate therebetween and configured to sandwich the sheet bundle. The sheet surface is pressed into a sheet folding section by the folding plate and the sheet bundle is carried with both side surfaces of the folded position sandwiched by the pair of rollers, whereby folding in half is performed on the sheet bundle.

Furthermore, provided on the downstream side of the pair of folding rollers in the conveying direction of the sheet bundle is a pair of additional folding rollers configured to receive a drive force from a driving motor to reciprocate in the width direction of the sheets that is orthogonal to the conveying direction of the sheet bundle and perform additional folding on the fold line portion of the sheet bundle. This pair of additional folding rollers is disposed such that a first roller member and a second roller member each having an axis in the conveying direction of the sheet bundle sandwich the sheet bundle. With the first roller member and the second roller member sandwiching the fold line portion of the sheet bundle, the pair of additional folding rollers reciprocates in the direction of the sheet width, whereby additional folding is performed on the fold line portion.

The inventors of the present application have developed a sheet processing apparatus that includes the above-described pair of additional folding rollers with a first roller member and a second roller member, in which the first roller member and the second roller member are displaced relative to each other in the direction of the sheet width. With the first roller member and the second roller member thus displaced relative to each other in the direction of the sheet width, folding is performed while a sheet bundle is wound onto each roller member, whereby the folding force can be increased. Furthermore, this sheet processing apparatus causes a pressing spring to press the first roller member toward the second roller member, thereby pressurizing a fold line portion of the sheet bundle sandwiched between the first roller member and the second roller member.

In a sheet processing apparatus configured as above, when a pair of additional folding rollers is reciprocated in the width direction of sheets to additionally fold a fold line portion of a sheet bundle, the load applied when the pair of additional folding rollers is moved varies depending on the orientation in which the pair of additional folding rollers moves in the direction of the sheet width.

More specifically, with a first orientation in which the pair of additional folding rollers moves in a positional relation in which the first roller member pressed by the pressing spring precedes the second roller member, the load applied on the driving motor increases when the pair of additional folding rollers is moved. On the contrary, with a second orientation in which the pair of additional folding rollers moves in a positional relation in which the second roller member precedes the first roller member, the load applied on the driving motor decreases when the pair of additional folding rollers is moved.

If disregarding such a difference in the load applied on the driving motor due to the orientation in which the pair of additional folding rollers moves in the width direction of the sheets and causing the pair of additional folding rollers to reciprocate simply with the same driving condition of the driving motor between the first direction and the second direction, various problems as described below will arise.

For example, the driving condition of the driving motor is set so that the moving speed of the pair of additional folding rollers is the same in both the first orientation and the second orientation, based on the first orientation in which the load applied on the driving motor is high. The rotation speed and the torque of the driving motor have a relation in which the lower the rotation speed, the higher the torque.

With the first orientation in which the load applied on the driving motor is high, the pair of additional folding rollers cannot be moved if the torque of the driving motor is excessively low. For this reason, the rotation speed of the driving motor needs to be low in order to obtain a high torque, and if the rotation speed of the driving motor is thus set low, the pair of additional folding rollers will be moved at a low speed. Furthermore, if the driving condition of the driving motor is set so that the moving speed of the pair of additional folding rollers is the same in both the first orientation and the second orientation as described above, the pair of additional folding rollers will be moved at a speed lower than required with the second orientation in which the load applied on the driving motor is low. This will cause extra time in an additional folding operation performed with the pair of additional folding rollers moved in the second orientation, thereby lowering the productivity of additionally folded sheet bundles.

As one driving condition other than the one described above, the electric current applied to the driving motor for driving the pair of additional folding rollers is set to the same value between the first orientation and the second orientation, and the current value is set based on the first orientation in which the load applied on the driving motor is high. The current value applied to the driving motor and the torque of the driving motor have a relation in which the higher the current value, the higher the torque.

With the first orientation in which the load applied on the driving motor is high, the pair of additional folding rollers cannot be moved if the torque of the driving motor is excessively low as described above. The current value applied to the driving motor thus needs to be set high in order to obtain a high torque. If the driving condition is set so that the same current value is applied in both the first orientation and the second orientation as described above, electric current with a value higher than required will be applied to the driving motor with the second orientation in which the load applied on the driving motor is low. This will cause waste electricity in the additional folding operation performed with the pair of additional folding rollers moved in the second orientation, and energy saving will not be achieved.

In view of the above-described problems, there is need to provide a sheet processing apparatus capable of controlling various problems that can be generated when using a pressurizing unit including a first pressurizing member and a second pressurizing member disposed in a manner displaced in the direction of a fold of sheets, and an image forming system including the sheet processing apparatus.

SUMMARY OF THE INVENTION

It is an object of the present invention to at least partially solve the problems in the conventional technology.

According to the present invention, there is provided a sheet processing apparatus comprising: a pressurizing unit configured to pressurize a fold line portion of a sheet bundle in a sandwiching manner between a first pressurizing member and a second pressurizing member; and a moving unit configured to move the pressurizing unit in the direction of the fold line of the sheet bundle, the moving unit including at least a driving motor, wherein the position where the sheet bundle is pressurized by the first pressurizing member and the position where the sheet bundle is pressurized by the second pressurizing member are shifted in the direction of the fold line of the sheet bundle, and a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member.

The present invention also provides an image forming system including: an image forming apparatus configured to form an image on a sheet; and a sheet processing apparatus configured to perform folding processing on the sheet with the image formed by the image forming apparatus thereon.

In the above-defined image forming system, the sheet processing apparatus comprises; a pressurizing unit configured to pressurize a fold line portion of a sheet bundle in a sandwiching manner between a first pressurizing member and a second pressurizing member; and a moving unit configured to move the pressurizing unit in the direction of the fold line of the sheet bundle, the moving unit including at least a driving motor, wherein the position where the sheet bundle is pressurized by the first pressurizing member and the position where the sheet bundle is pressurized by the second pressurizing member are shifted in the direction of the fold line of the sheet bundle, and a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
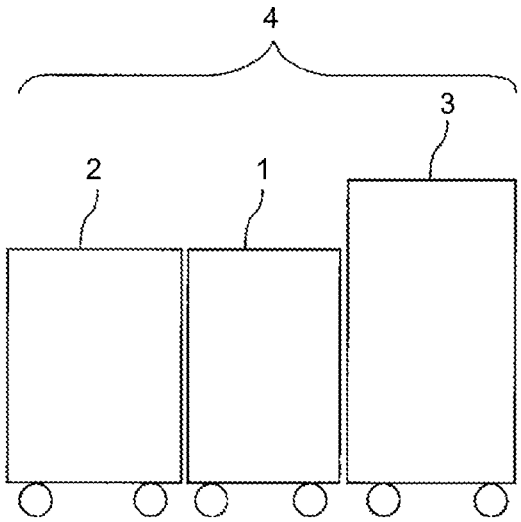
FIG. 2 is a diagram illustrating a system configuration of an image forming system according to an embodiment of the present invention.

FIG. 2 is a diagram illustrating the system configuration of an image forming system 4 including an image forming apparatus and a plurality of sheet processing apparatuses according to an embodiment of the present invention. In the image forming system 4 in the present embodiment, a sheet bundling apparatus 1 serving as a first sheet post-processing apparatus and a saddle-stitching bookbinding apparatus 2 serving as a second sheet post-processing apparatus are sequentially provided in the subsequent stage of an image forming apparatus 3.

The image forming apparatus 3 is configured to form an image on a sheet based on image data that has been input or image data that has been read from an image. For example, a copying machine, a printer, a facsimile machine, or a digital multifunctional peripheral having at least two of these functions correspond to the image forming apparatus 3. The image forming apparatus 3 may employ any type of image forming method including known methods such as electrophotographic system and liquid droplet injection system. It should be noted that an electrophotographic copying machine is used in the present embodiment.

Figure 3:
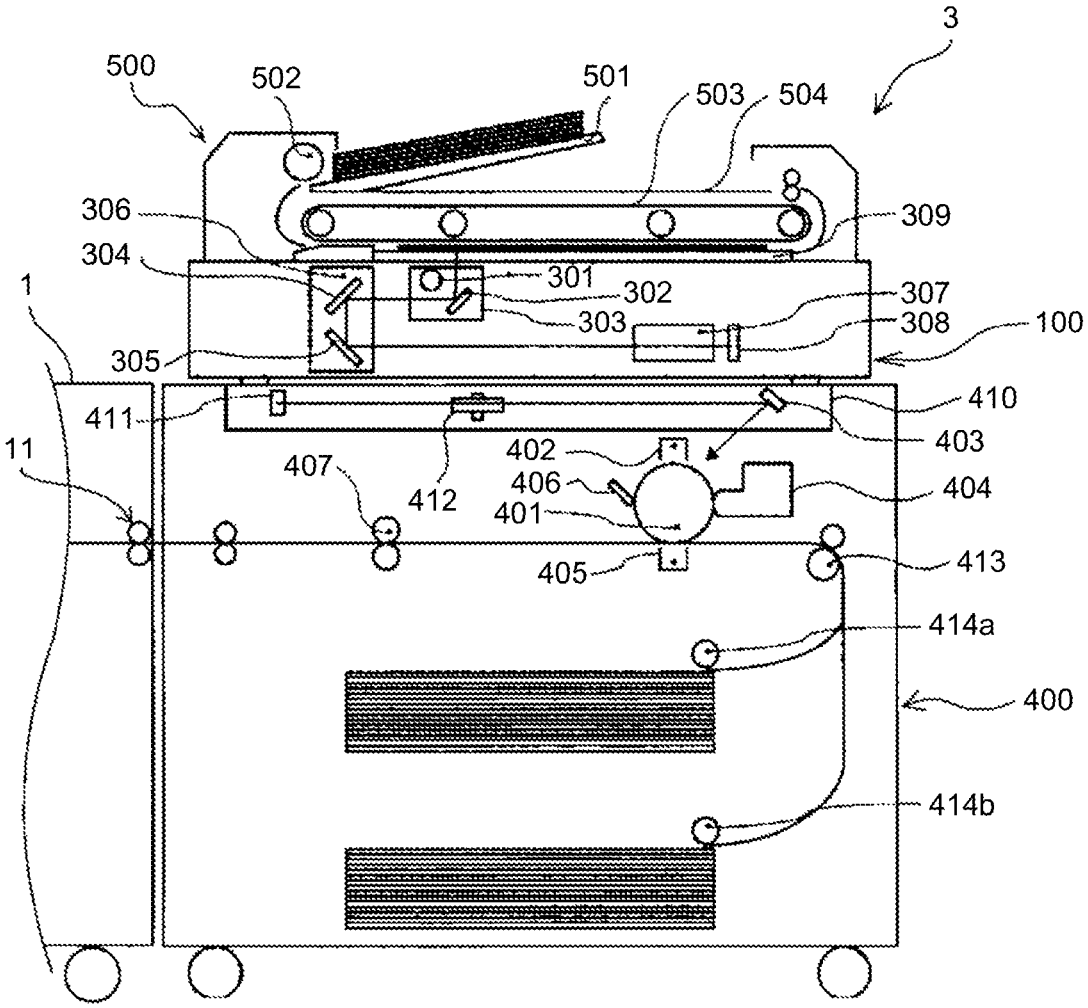
FIG. 3 is a diagram for explaining an image forming apparatus included in the image forming system.

FIG. 3 is a diagram for explaining the image forming apparatus 3.

An image forming apparatus main body 400 includes feeding cassettes for containing sheets serving as recording media in the lower part of an image forming unit. Each of the sheets contained in the feeding cassettes is fed by feeding rollers 414*a* and 414*b* before carried to the upper part along a predetermined conveying path to reach a pair of registration rollers 413.

The image forming unit includes a photosensitive drum 401 as an image carrier, a charging device 402, an exposure device 410, a developing device 404, a transfer device 405, and a cleaning device 406.

The charging device 402 is a charging unit for charging the surface of the photosensitive drum 401 uniformly. The exposure device 410 is a latent image forming unit for forming a latent image on the photosensitive drum 401 based on image information read by an image reading device 100. The developing device 404 is a developing unit for attaching toner to an electrostatic latent image on the photosensitive drum 401 to visualize the electrostatic latent image. The transfer device 405 is a transfer unit for transferring a toner image on the photosensitive drum 401 onto a sheet. The cleaning device 406 is a cleaning unit for removing residual toner left on the photosensitive drum 401 after the transferring process.

Furthermore, disposed on the downstream side in the sheet conveying direction of the image forming unit is a fixing device 407 as a fixing unit for fixing the toner image on the sheet.

The exposure device 410 includes a laser unit 411 that emits laser light based on the image information under the control of a controller (not illustrated) and a polygon mirror 412 that causes the laser light from the laser unit 411 to scan, via mirror 403, the photosensitive drum 401 in the direction of its rotary shaft (main-scanning direction).

Furthermore, connected to the upper part of the image reading device 100 is an automatic document feeding device 500. The automatic document feeding device 500 includes a document table 501, a document separating and feeding roller 502, a feeding belt 503, and a document discharging tray 504.

When documents are set on the document table 501 and a reading start instruction is received, the documents on the document table 501 are fed out by the document separating and feeding roller 502 one by one in the automatic document feeding device 500. Each of the documents is then guided onto a platen glass 309 by the feeding belt 503 before temporarily stopped.

Image information on the documents temporarily stopped on the platen glass 309 is then read by the image reading device 100. Thereafter, the feeding belt 503 restarts feeding the documents and the documents thus fed are discharged into the document discharging tray 504.

An image reading operation and an image forming operation will now be described.

Once a document has been fed onto the platen glass 309 by the automatic document feeding device 500 or placed on the platen glass 309 by the user, and an operation panel (not illustrated) has received a copy start operation, a light source 301 on a first runner 303 turns on. This causes the first runner 303 and a second runner 306 to be moved along a guide rail (not illustrated) at the same time.

Light is then emitted from the light source 301 onto the document placed on the platen glass 309, and reflected light thereof is guided by a mirror 302 on the first runner 303 and a mirror 304 and a mirror 305 on the second runner 306, and a lens 307 to be received by a CCD 308. This causes the CCD 308 to read image information on the document and the image information thus read is converted from analog data into digital data by an A/D conversion circuit. This image information is sent from an information outputting unit (not illustrated) to the image forming apparatus main body 400.

The image forming apparatus main body 400 starts to drive the photosensitive drum 401. When the photosensitive drum 401 is rotated at a predetermined speed, the image forming apparatus main body 400 causes the charging device 402 to charge the surface of the photosensitive drum 401 uniformly. The exposure device 410 then forms an electrostatic latent image based on the image information read by the image reading device on the surface of the photosensitive drum 401 thus charged.

The electrostatic latent image on the surface of the photosensitive drum 401 is developed by the developing device 404 to be a toner image. a sheet contained in one of the feeding cassettes is fed by the feeding rollers 414*a* or 414*b* and temporarily stopped by the pair of registration rollers 413.

The sheet is then fed into a transfer unit by the pair of registration roller 413 in accordance with the timing that the leading end of the toner image thus formed on the surface of the photosensitive drum 401 reaches a transfer section opposing the transfer device 405. When the sheets pass the transfer section, the toner image formed on the surface of the photosensitive drum 401 is transferred onto the sheet by the action of the transfer electric field.

The sheets are then carried to the fixing device 407 and undergo fixing processing performed by the fixing device 407 before discharged into the sheet bundling apparatus 1 in the subsequent stage. It should be noted that residual toner left on the surface of the photosensitive drum 401 that had not been transferred to the sheet at the transfer section is removed by the cleaning device 406.

Figure 4:
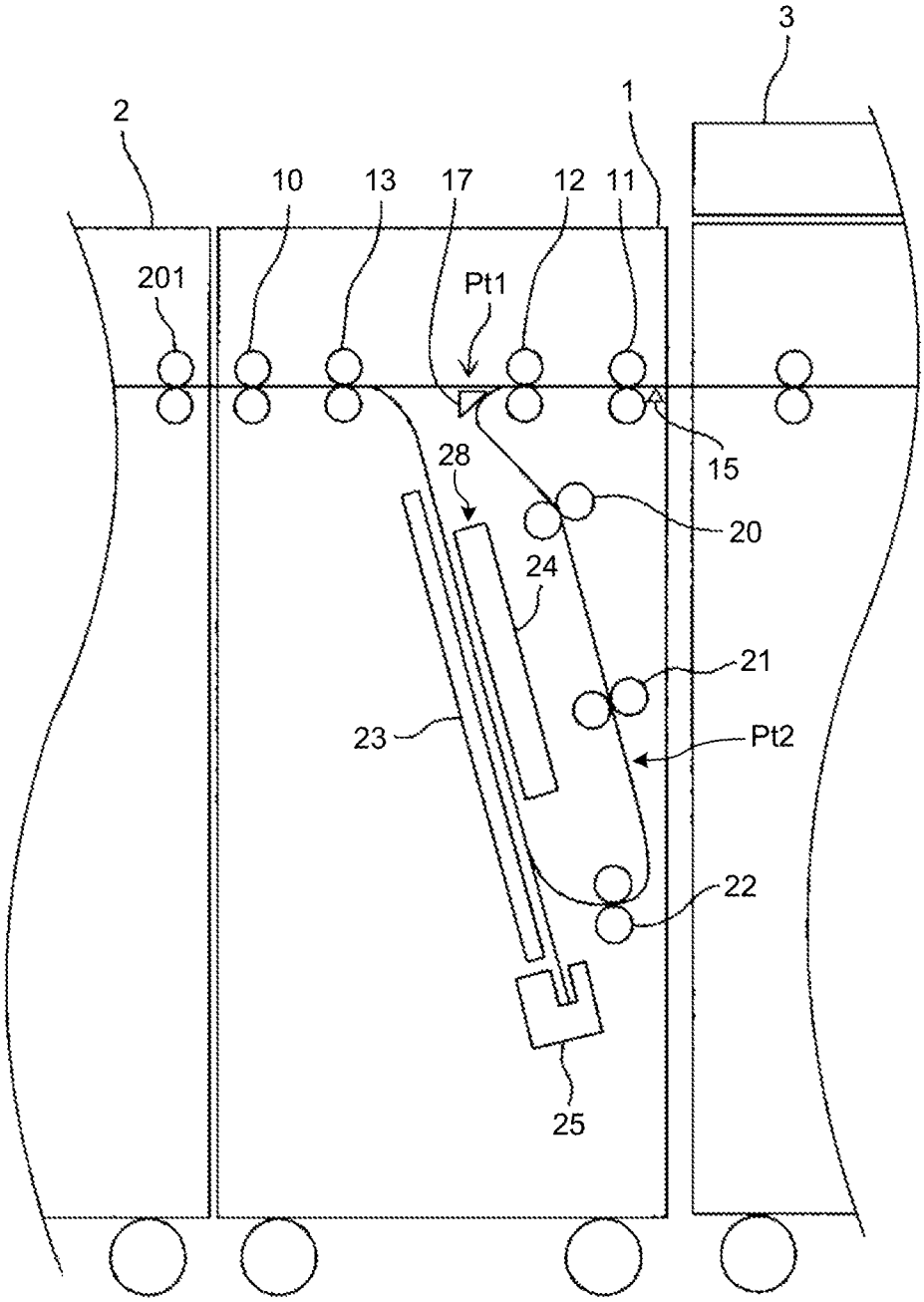
FIG. 4 is a diagram for explaining a sheet bundling apparatus included in the image forming system.

FIG. 4 is a diagram for explaining the sheet bundling apparatus 1.

The sheet bundling apparatus 1 is a sheet post-processing apparatus that has a sheet bundle creating function for receiving the sheets one by one from the image forming apparatus 3 and performing superposition and registration sequentially on the sheets thus received to create a sheet bundle SB.

The sheet bundling apparatus 1 includes a conveying path Pt1 for receiving the sheets discharged from the image forming apparatus 3 and discharging the sheets thus received, without any processing, into the saddle-stitching bookbinding apparatus 2 in the subsequent stage. The sheet bundling apparatus 1 further includes a conveying path Pt2 for bundling sheets, that is bifurcated off from the conveying path Pt1. Each of the conveying paths Pt1 and Pt2 is formed of a guide member (not illustrated), for example.

Sequentially disposed on the conveying path Pt1 from the upstream side of the conveying path Pt1 to the downstream side of the conveying path Pt1 in the sheet conveying direction are a pair of inlet rollers 11, a pair of carriage rollers 12, a pair of carriage rollers 13, and a pair of sheet discharging rollers 10.

In the description below, the upstream side in the sheet conveying direction may be simply referred to as the upstream side, and the downstream side in the sheet conveying direction may be simply referred to as the downstream side.

The pair of inlet rollers 11, the pair of carriage rollers 12, the pair of carriage rollers 13, and the pair of sheet discharging rollers 10 are rotationally driven by a motor (not illustrated) to carry the sheets.

Disposed on the upstream side in the sheet conveying direction of the pair of inlet rollers 11 is an inlet sensor 15. The inlet sensor 15 detects that a sheet has been carried into the sheet bundling apparatus 1. Disposed on the downstream side in the sheet conveying direction of the pair of carriage rollers 12 is a bifurcating claw 17 that is rotatable and driven by a motor or a solenoid, for example. The bifurcating claw 17 is rotated to change the position thereof, thereby selectively guiding the sheets either to the section on the downstream side in the sheet conveying direction of the bifurcating claw 17 on the conveying path Pt1 or to the conveying path Pt2.

In the discharging mode, the sheets carried onto the conveying path Pt1 from the image forming apparatus 3 are carried by the pair of inlet rollers 11, the pairs of carriage rollers 12 and 13, and the pair of sheet discharging rollers 10 to be discharged into the saddle-stitching bookbinding apparatus 2 in the subsequent stage.

In contrast, in the sheet bundling mode, the sheets carried onto the conveying path Pt1 are carried by the pair of inlet rollers 11 and the pair of carriage roller 12 and caused to change the direction thereof by the bifurcating claw 17 to be carried onto the conveying path Pt2.

Disposed on the conveying path Pt2 are pairs of carriage rollers 20, 21, and 22, a sheet stacking tray 23, a jogger fence 24, and a trailing-end reference fence 25, for example. It should be noted that the pairs of carriage rollers 20, 21, and 22 and the jogger fence 24 are driven by a motor (not illustrated).

The sheets carried onto the conveying path Pt2 are sequentially stacked on the sheet stacking tray 23. A sheet bundle is thus formed with a plurality of sheets stacked. During this operation, the position of the sheet bundle in the sheet conveying direction is aligned by a movable reference fence (not illustrated) provided on the sheet stacking tray 23 and the trailing-end reference fence 25, and at the same time, the position of the sheet bundle in the width direction is aligned by the jogger fence 24. It should be noted that the movable reference fence is driven by a motor.

The sheet stacking tray 23, the jogger fence 24, the trailing-end reference fence 25, and the movable reference fence together constitute a bundling section 28 serving as a bundling unit that stacks a plurality of sheets to form a sheet bundle. The bundling section 28 also includes the motor that drives the jogger fence 24 and the motor that drives the movable reference fence.

The sheet bundle bundled by the bundling section 28 is carried onto the conveying path Pt1 by the movable reference fence and then discharged into the saddle-stitching bookbinding apparatus 2 in the subsequent stage by the pair of carriage rollers 13 and the pair of sheet discharging rollers 10.

Figure 5:
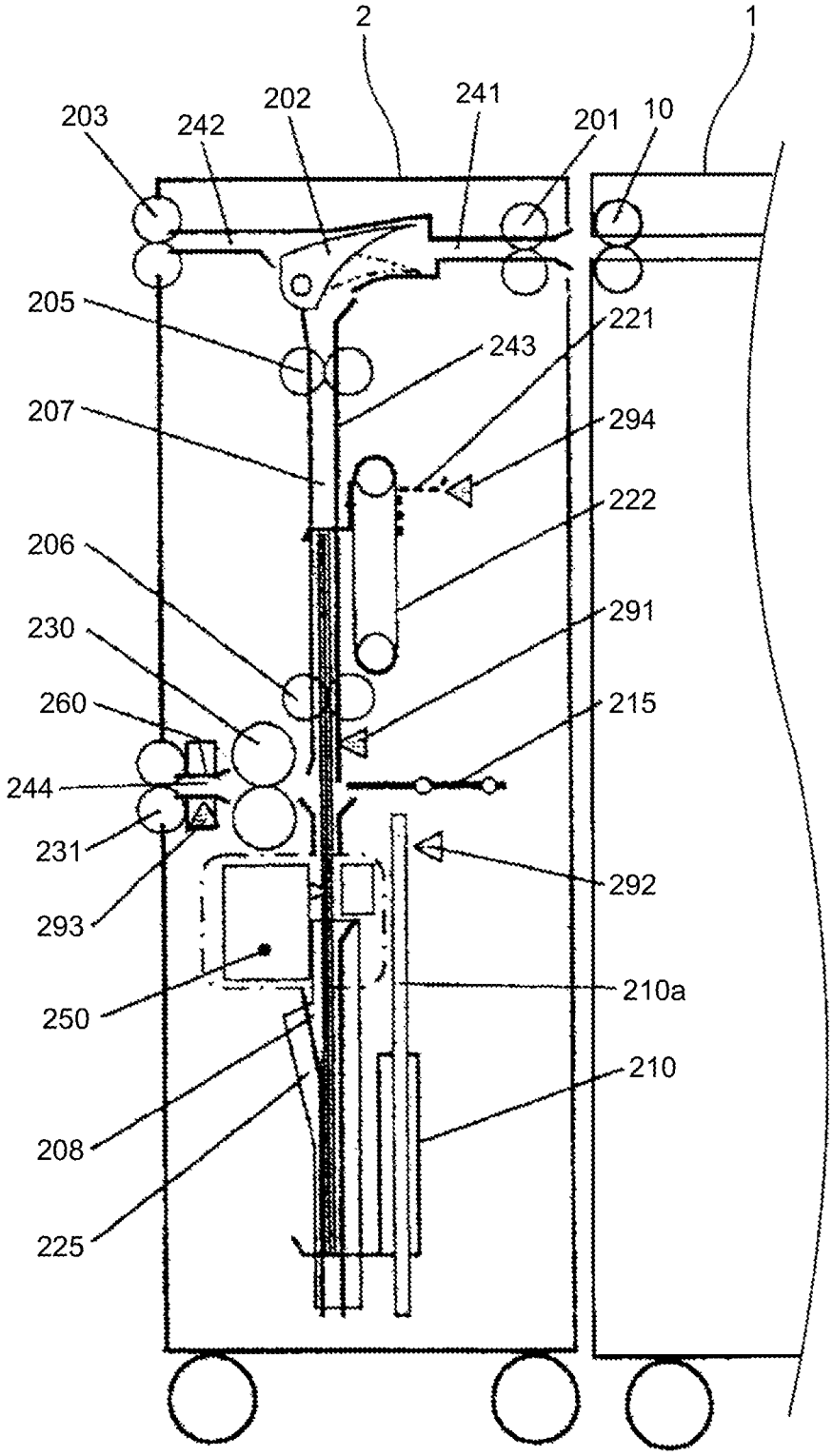
FIG. 5 is a diagram for explaining a saddle-stitching bookbinding apparatus included in the image forming system.

FIG. 5 is a diagram for explaining the saddle-stitching bookbinding apparatus 2. The saddle-stitching bookbinding apparatus 2 receives the sheet bundle SB discharged from the sheet bundling apparatus 1 and performs saddle-stitching processing and center-folding processing on the sheet bundle thus received.

The saddle-stitching bookbinding apparatus 2 includes an inlet conveying path 241, a sheet-through conveying path 242, and a center-folding conveying path 243, for example. Provided in the most upstream side in the sheet conveying direction of the inlet conveying path 241 is a pair of inlet rollers 201, with which the sheet bundle SB discharged from the pair of sheet discharging rollers 10 of the sheet bundling apparatus 1 is carried into the saddle-stitching bookbinding apparatus 2.

Rotatably provided on the downstream side of the pair of inlet rollers 201 in the inlet conveying path 241 is a bifurcating claw 202. The bifurcating claw 202 is installed in the horizontal direction in FIG. 5, and bifurcates the conveying direction of the sheet bundle SB into the direction toward the sheet-through conveying path 242 and the direction toward the center-folding conveying path 243.

The sheet-through conveying path 242 is a path that extends horizontally from the inlet conveying path 241 and guides the sheet bundle SB to a sheet discharging tray (not illustrated) or a sheet processing device in the subsequent stage (not illustrated). Furthermore, the sheet bundle SB carried through the sheet-through conveying path 242 is discharged to the sheet discharging tray or the sheet processing device in the subsequent stage by an upper discharging roller 203.

The center-folding conveying path 243 is a conveying path that extends vertically downward from the position of the bifurcating claw 202 and is used for saddle-stitching processing and center-folding processing performed on the sheet bundle SB.

The center-folding conveying path 243 is provided with a folding plate 215 for performing center-folding on the sheet bundle SB. The center-folding conveying path 243 is further provided with an upper sheet bundle conveying guide board 207 that guides the sheet bundle SB above the folding plate 215 and a lower sheet bundle conveying guide board 208 that guides the sheet bundle SB below the folding plate 215, for example.

The upper sheet bundle conveying guide board 207 is provided with upper sheet bundle carriage rollers 205, a trailing-end hitting claw 221, and lower sheet bundle carriage rollers 206, to describe in order from the top.

The trailing-end hitting claw 221 is installed in a standing manner on a trailing-end hitting claw driving belt 222 that is driven by a driving motor (not illustrated). The trailing-end hitting claw 221 hits (presses) the trailing end of the sheet bundle to the movable fence side by the reciprocating rotation motion of the trailing-end hitting claw driving belt 222 to perform the registration operation of the sheet bundle SB. The trailing-end hitting claw 221 also recedes from the center-folding conveying path 243 (the position marked with a broken line in FIG. 5) when the sheet bundle SB is carried in or raised for the purpose of center-folding.

A trailing-end hitting claw home-position sensor 294 is a sensor for detecting the home position of the trailing-end hitting claw 221, and detects the position marked with a broken line in FIG. 5 (the position marked with a solid line in FIG. 6) where the trailing-end hitting claw 221 is located after receding from the center-folding conveying path 243 as the home position. It should be noted that the trailing-end hitting claw 221 is controlled with reference to this home position.

Provided on the lower sheet bundle conveying guide board 208 is a saddle-stitching stapler 250, a saddle-stitching jogger fence 225, and a movable fence 210, to describe in order from the top.

The lower sheet bundle conveying guide board 208 is a guide board that receives the sheet bundle SB carried in through the upper sheet bundle conveying guide board 207. Installed in the width direction of the lower sheet bundle conveying guide board 208 is a pair of saddle-stitching jogger fence 225. In the lower part than the lower sheet bundle conveying guide board 208, the movable fence 210 that can be moved in the vertical direction is installed, which is abutted by the leading end of the sheet bundle.

The saddle-stitching stapler 250 is a binding tool that binds the center portion of the sheet bundle SB. The movable fence 210 is moved in the vertical direction with the leading end of the sheet bundle SB abutted thereon to locate the center position of the sheet bundle SB in the position opposing the saddle-stitching stapler 250. In this position, stapling processing, that is, saddle-stitching is performed on the sheet bundle SB.

The movable fence 210 is supported by a movable fence driving mechanism 210*a* and can be moved from the position of a movable fence home-position sensor 292 of the movable fence driving mechanism 210*a* at the highest to the position of the lowermost part of the movable fence driving mechanism 210*a* at the lowest.

For the movable range of the movable fence 210 abutted by the leading end of the sheet bundle SB, a range is secured for all sizes from the largest to the smallest that can be handled by the saddle-stitching bookbinding apparatus 2. It should be noted that a rack and pinion mechanism, for example, is used as the movable fence driving mechanism 210*a*.

Provided between the upper sheet bundle conveying guide board 207 and the lower sheet bundle conveying guide board 208, namely, approximately in the center of the center-folding conveying path 243 are the folding plate 215, a pair of folding rollers 230, an additional folding roller unit 260, and lower sheet discharging rollers 231, for example.

The additional folding roller unit 260 is provided with an upper additional folding roller 261*a* and a lower additional folding roller 262*a* (see FIG. 11) together constituting a pair of rollers with a sheet discharging path between the pair of folding rollers 230 and the lower sheet discharging rollers 231 interposed therebetween.

The folding plate 215 can reciprocate in the horizontal direction in FIG. 5. The nip of the pair of folding rollers 230 is positioned on the downstream side of the folding plate 215 in the direction that the folding plate 215 moves in performing a folding operation. On the extension line from the nip, a sheet discharge conveying path 244 is installed.

The lower sheet discharging rollers 231 are provided in the most downstream of the sheet discharge conveying path 244 to discharge, in the subsequent stage, the sheet bundle SB having undergone folding processing.

Provided on the lower end side of the upper sheet bundle conveying guide board 207 is a sheet bundle detecting sensor 291 to detect the leading end of the sheet bundle SB that is carried into the center-folding conveying path 243 and passing the center-folding position. Furthermore, the sheet discharge conveying path 244 is provided with a fold line portion passing sensor 293 to detect the leading end of the sheet bundle SB thus center-folded in half to determine that the sheet bundle SB is passing.

In the saddle-stitching bookbinding apparatus 2 configured as illustrated in FIG. 5, the saddle-stitching operation and the center-folding operation are performed as illustrated in the operation explanatory diagrams in FIGS. 6 to 10. Specifically, when saddle-stitching and center-folding are selected from the operation panel (not illustrated) of the image forming apparatus 3, the sheet bundle SB, for which the saddle-stitching and the center-folding are selected, is guided from the inlet conveying path 241 to the center-folding conveying path 243 by the rotation motion of the bifurcating claw 202 in the counterclockwise direction in FIG. 5. Although the bifurcating claw 202 is driven by a solenoid in the present embodiment, the bifurcating claw 202 may be driven by a motor instead of a solenoid.

Figure 6:
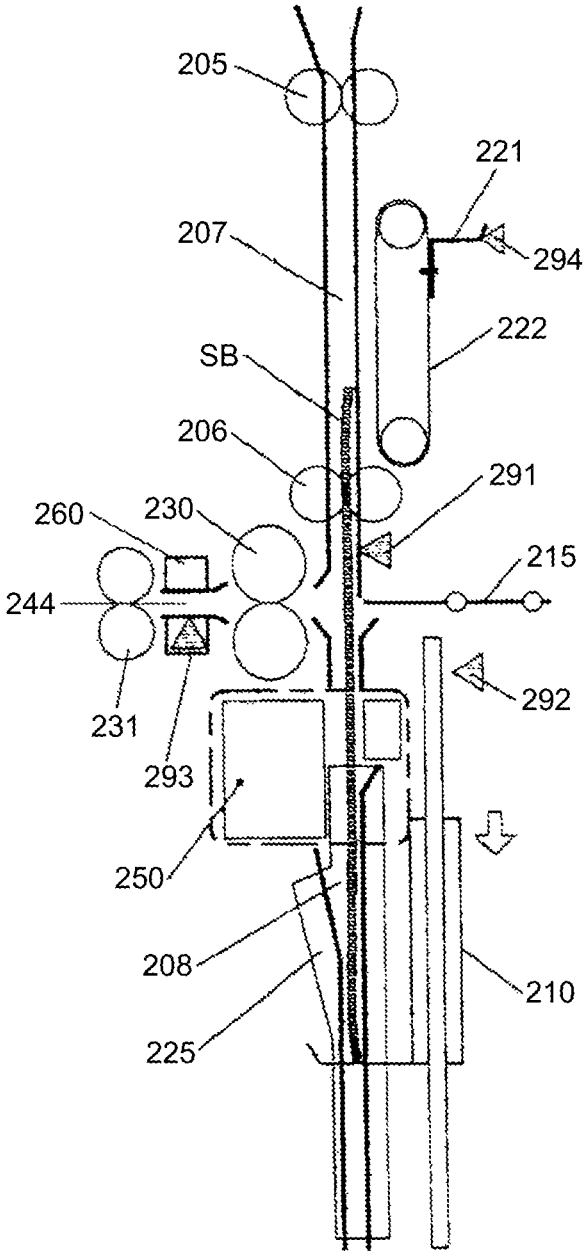
FIG. 6 is an operation explanatory diagram of the saddle-stitching bookbinding apparatus, illustrating a state in which a sheet bundle is being carried onto a center-folding conveying path.

The sheet bundle SB carried into the center-folding conveying path 243 is carried through the center-folding conveying path 243 in the downward direction by the pair of inlet rollers 201 and the upper sheet bundle carriage rollers 205. After the sheet bundle detecting sensor 291 detects that the leading end of the sheet bundle SB has passed, the lower sheet bundle carriage rollers 206 carry the sheet bundle SB to the position where the leading end of the sheet bundle SB abuts the movable fence 210, as illustrated in FIG. 6.

In this process, the movable fence 210 is stopped in different stopping positions depending on information of the sheet size, or information of the size of each sheet bundle SB in the conveying direction in this case, from the image forming apparatus 3. At this point, the lower sheet bundle carriage rollers 206 hold the sheet bundle SB in a sandwiching manner with the nip thereof and the trailing-end hitting claw 221 waits in the home position thereof shown in FIG. 6.

Figure 7:
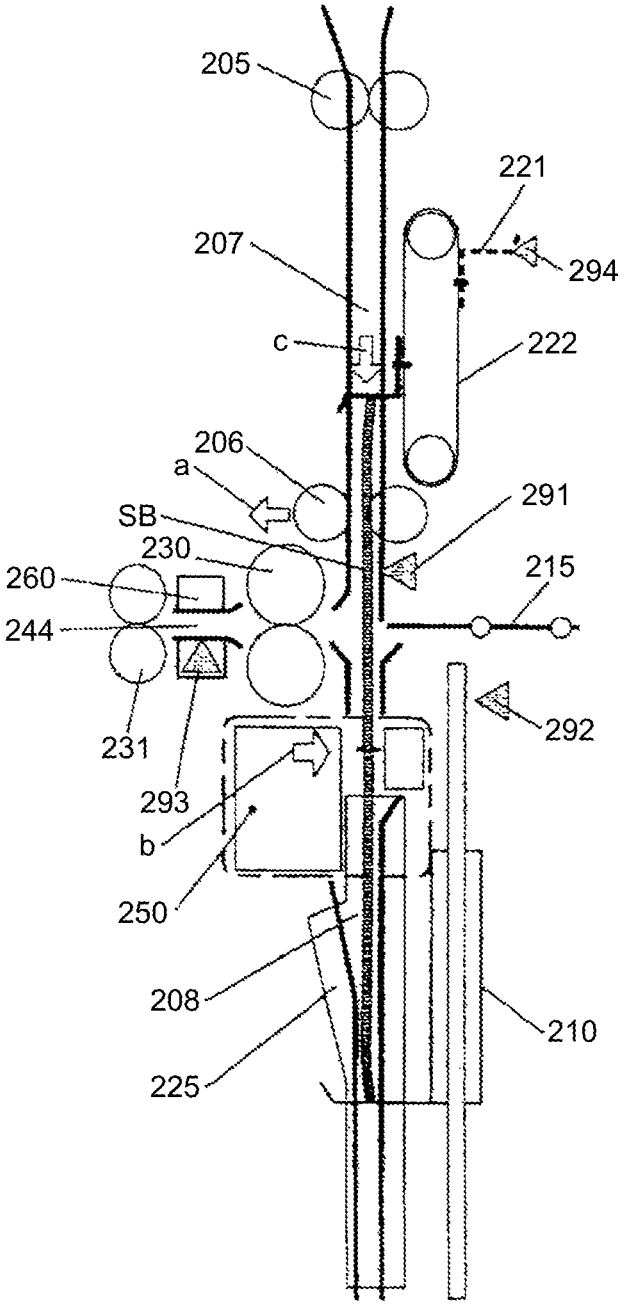
FIG. 7 is an operation explanatory diagram of the saddle-stitching bookbinding apparatus, illustrating a state in which the sheet bundle is being saddle-stitched.

In this state, the hold in a sandwiching manner by the lower sheet bundle carriage rollers 206 is released as illustrated in FIG. 7 (in a direction indicated by an arrowed line a in FIG. 7), the leading end of the sheet bundle SB abuts the movable fence 210, and the sheet bundle SB is stacked with the trailing end thereof in the free state. Thereafter, the trailing-end hitting claw 221 is driven to hit the trailing end of the sheet bundle SB, thereby performing the final alignment of the sheet bundle SB in the conveying direction (in the direction indicated by an arrowed line c in FIG. 7).

The alignment operation of the sheet bundle SB in the width direction (the direction orthogonal to the sheet conveying direction) is then performed by the saddle-stitching jogger fence 225. The alignment operations of the sheet bundle SB in the width direction and the conveying direction are thus performed, whereby the registration operation of the sheet bundle SB in the width direction and the conveying direction is completed. For these operations, the quantities to be pressed by the trailing-end hitting claw 221 and the saddle-stitching jogger fence 225 are changed to appropriate values based on information such as the sheet size, the number of the sheets in the sheet bundle SB, and the thickness of the sheet bundle. The registration operation is performed based on the values.

Furthermore, the thicker the sheet bundle SB is, the space inside of the center-folding conveying path 243 decreases. Only one registration operation therefore cannot completely perform the registration of the sheet bundle SB in many cases. For this reason, the number of times of registration of the sheet bundle SB for such a case increases. This can provide a better registration condition.

It should be noted that the larger the number of the sheets is, the more it takes time required to stack a plurality of sheets sequentially to form a sheet bundle SB with the sheet bundling apparatus 1 provided in the stage prior to the saddle-stitching bookbinding apparatus 2. The time allowed for the saddle-stitching bookbinding apparatus 2 to receive the next sheet bundle SB from the sheet bundling apparatus 1 also increases accordingly. Therefore, even if the number of times of registration of the sheet bundle SB increases for the saddle-stitching bookbinding apparatus 2, no time loss is generated for the system as a whole, and a good registration condition can be thus achieved effectively. This makes it possible to control the number of times of registration of the sheet bundle SB performed by the saddle-stitching bookbinding apparatus 2 in accordance with the processing time required in the sheet bundling apparatus 1 and other components provided in the stage prior to the saddle-stitching bookbinding apparatus 2.

It should be noted that the waiting position of the movable fence 210 is normally set to the position where the saddle-stitching position of the sheet bundle SB opposes the binding position of the saddle-stitching stapler 250. This is because if registration of the sheet bundle SB is performed in this position, binding processing can be performed in the position where the sheet bundle SB is stacked in the center-folding conveying path 243 without moving the movable fence 210 to the center-folding position of the sheet bundle SB. The stitcher of the saddle-stitching stapler 250 is then moved in the direction indicated by an arrowed line b in FIG. 7 to the center portion of the sheet bundle SB in this waiting position and performs binding processing with the clincher, whereby the saddle-stitching is performed on the sheet bundle SB.

The movable fence 210 is positioned under the pulse control from the movable fence home-position sensor 292. The trailing-end hitting claw 221 is positioned under the pulse control from the trailing-end hitting claw home-position sensor 294. The positioning controls of the movable fence 210 and the trailing-end hitting claw 221 are performed by a CPU of a control circuit (not illustrated) of the saddle-stitching bookbinding apparatus 2.

Figure 8:
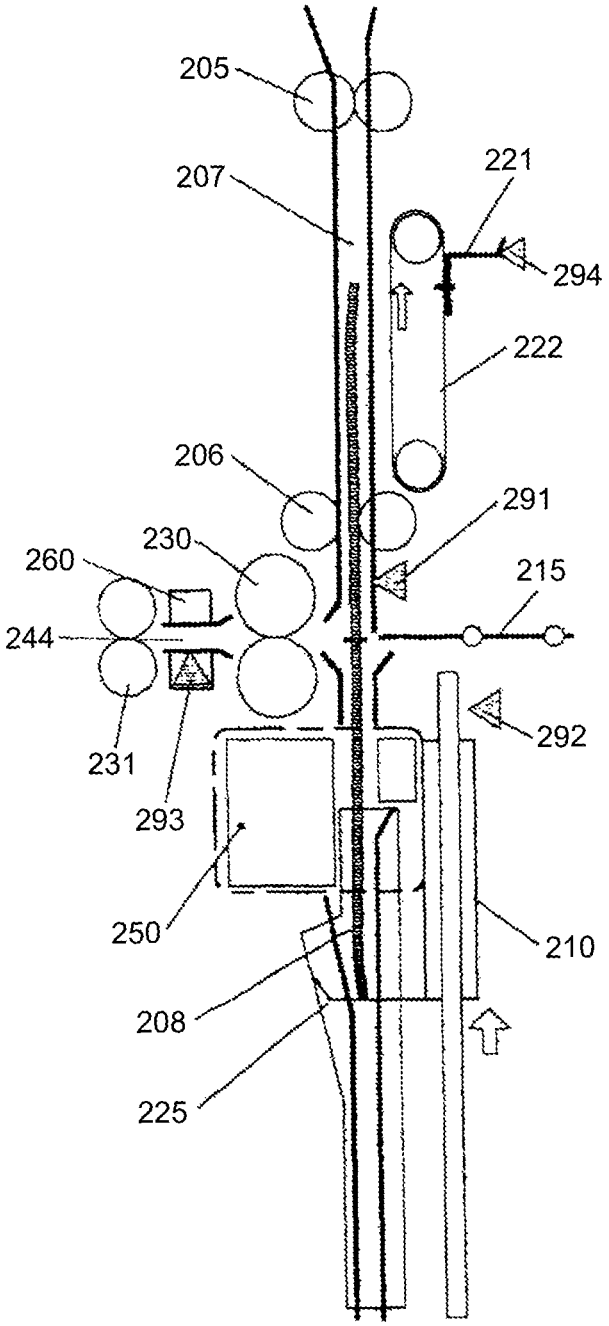
FIG. 8 is an operation explanatory diagram of the saddle-stitching bookbinding apparatus, illustrating a state in which the sheet bundle has moved to a center-folding position.

The sheet bundle SB saddle-stitched in the state illustrated in FIG. 7 is conveyed to the position where the saddle-stitching portion thereof opposes the folding plate 215 with the hold in a sandwiching manner by the lower sheet bundle carriage rollers 206 released as illustrated in FIG. 8, in accordance with the upward movement of the movable fence 210. It should be noted that this position is also controlled with reference to the detection position of the movable fence home-position sensor 292. Furthermore, the saddle-stitching portion described above is the center portion in the sheet bundle SB conveying direction.

Figure 9:
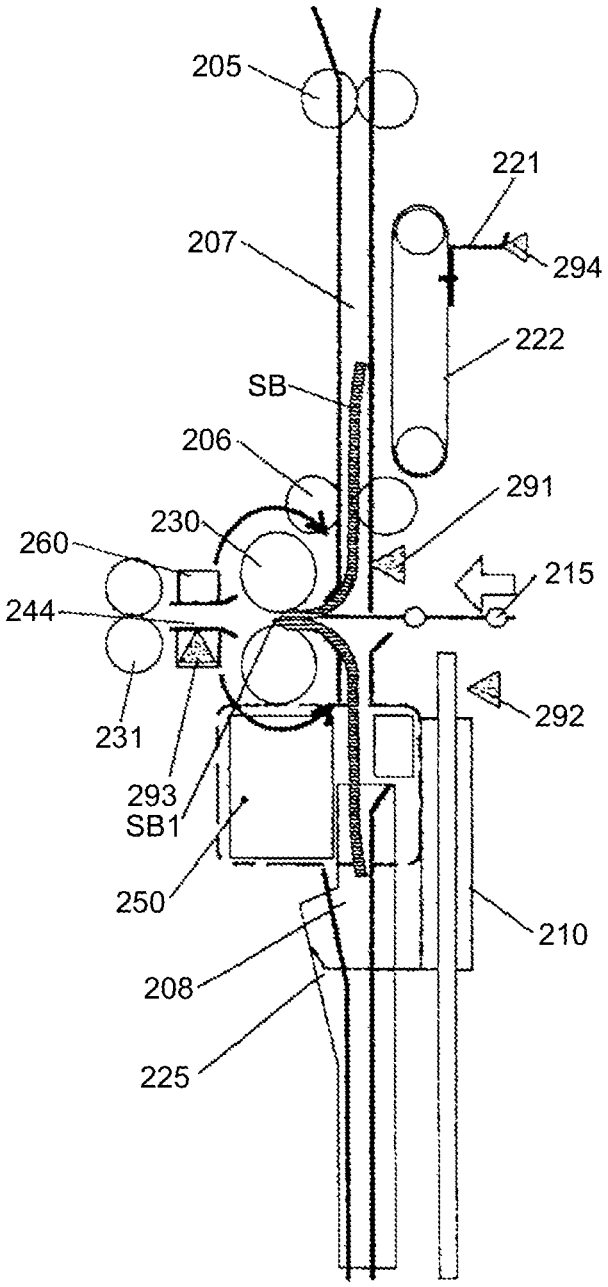
FIG. 9 is an operation explanatory diagram of the saddle-stitching bookbinding apparatus, illustrating a state in which a center-folding operation of the sheet bundle is being performed.

When the sheet bundle SB reaches the position illustrated in FIG. 8, the folding plate 215 is moved toward the nip of the pair of folding rollers 230 as illustrated in FIG. 9 to abut the part in the vicinity of the staples binding the sheet bundle SB from the approximately perpendicular direction thereto and press the part out toward the nip of the pair of folding rollers 230.

The sheet bundle SB is pressed by the folding plate 215 and guided to the nip of the pair of folding rollers 230 to be pressed in the nip of the pair of folding rollers 230 rotated in advance. The pair of folding rollers 230 carries the sheet bundle SB pressed in the nip thereof while pressurizing the sheet bundle SB. This pressure-carriage operation performs folding on the center of the sheet bundle SB, whereby a sheet bundle SB with simplified-bookbinding applied thereon is formed. It should be noted that FIG. 9 illustrates the state in which the leading edge of a fold line portion SB1 of the sheet bundle SB is sandwiched and pressurized by the nip of the pair of folding rollers 230.

Figure 10:
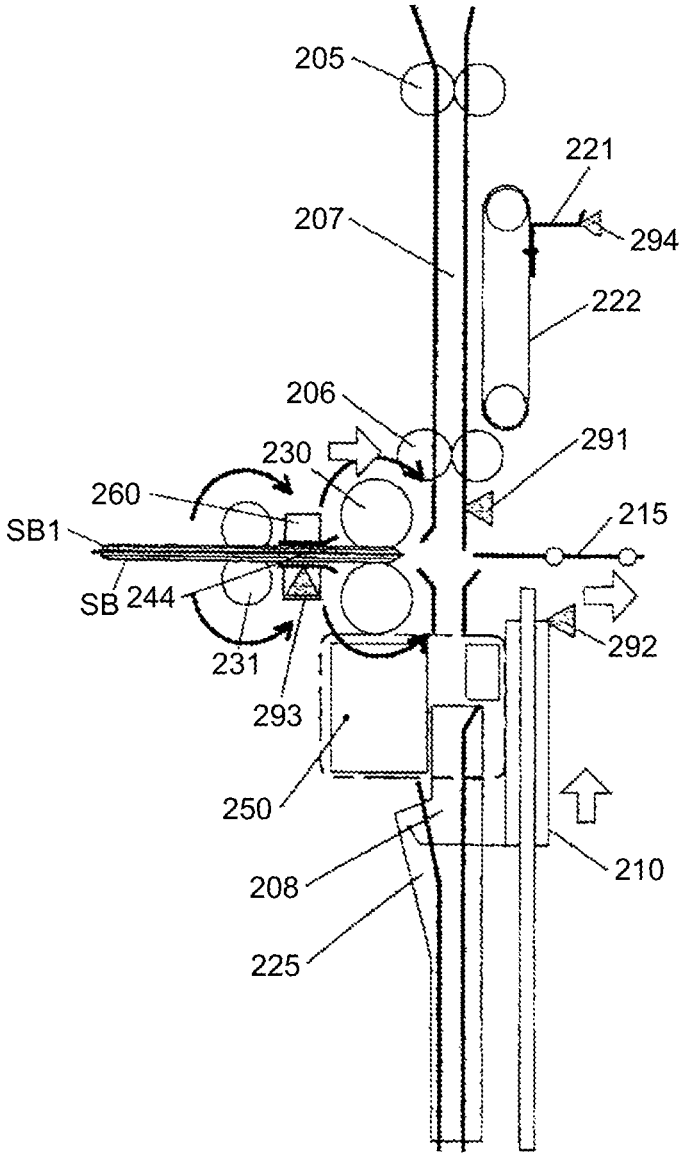
FIG. 10 is an operation explanatory diagram of the saddle-stitching bookbinding apparatus, illustrating a state in which the sheet bundle thus center-folded is being discharged.

In the state illustrated in FIG. 9, the sheet bundle SB with the center portion thereof folded in double is carried by the pair of folding rollers 230 as illustrated in FIG. 10 and further carried by the lower sheet discharging rollers 231 to be discharged in the subsequent stage. When the trailing end of the folded-in-half sheet bundle SB is detected by the fold line portion passing sensor 293 in the operation described above, the folding plate 215 and the movable fence 210 return to their home positions and the lower sheet bundle carriage rollers 206 return to the pressing state, preparing for the carrying-in of the next sheet bundle SB.

Furthermore, if the sheet bundle SB for the next job is formed of the same number of sheets with the same size, the movable fence 210 may be arranged to be moved to the position illustrated in FIG. 6 again to be waiting. It should be noted that these controls are also performed by the CPU of the control circuit described above.

Figure 11:
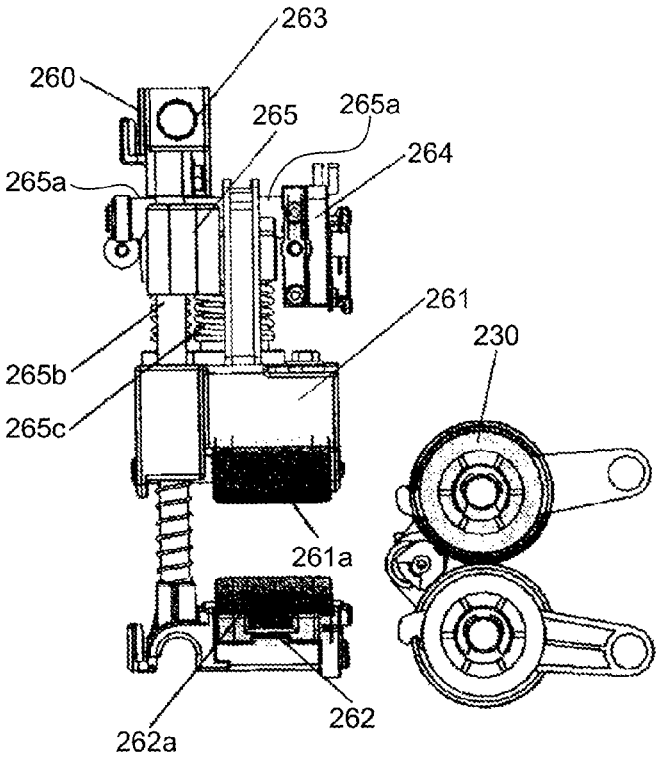
FIG. 11 is a main part front view illustrating the additional folding roller unit and a pair of folding rollers.
Figure 12:
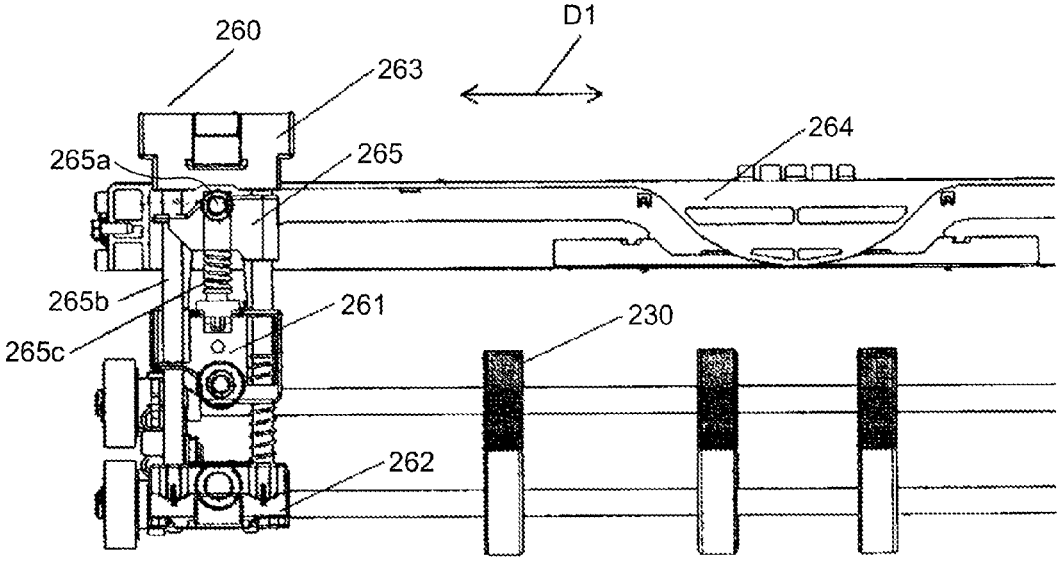
FIG. 12 is a main part side view of FIG. 11 as seen from the left side.

FIG. 11 is a main part front view illustrating the additional folding roller unit 260 and the pair of folding rollers 230. FIG. 12 is a main part side view of FIG. 11 as seen from the left side in FIG. 11.

The additional folding roller unit 260 is installed on the sheet discharge conveying path 244 between the pair of folding rollers 230 and the lower sheet discharging rollers 231 and includes a unit moving mechanism 263, a guide member 264, and a pressurizing mechanism 265, for example.

The pair of folding rollers 230 is structured as a pair of skewed rollers each of which includes a plurality of rollers disposed at intervals in the shaft direction.

The unit moving mechanism 263 causes the additional folding roller unit 260 to reciprocate in the depth direction in FIG. 12 (in the direction orthogonal to the sheet conveying direction) along the guide member 264 by means of a driving source and a driving mechanism (not illustrated).

The pressurizing mechanism 265 includes an additional folding roller upper unit 261 and an additional folding roller lower unit 262. The pressurizing mechanism 265 is a mechanism that pressurizes the sheet bundle SB from the vertical direction by causing the additional folding roller upper unit 261 and the additional folding roller lower unit 262 to apply pressure.

The additional folding roller upper unit 261 is supported by a supporting member 265*b* relative to the unit moving mechanism 263 in a vertically movable manner. The additional folding roller lower unit 262 is attached to the lower end of the supporting member 265*b* of the pressurizing mechanism 265 in a non-movable manner.

The upper additional folding roller 261*a* of the additional folding roller upper unit 261 can be pressed against the lower additional folding roller 262*a* of the additional folding roller lower unit 262. The sheet bundle SB is sandwiched and pressurized in the nip of the upper additional folding roller 261*a* and the lower additional folding roller 262*a*. The pressurizing force in this operation is applied by a pressing spring 265*c* that pressurizes the additional folding roller upper unit 261 with an elastic force. With the sheet bundle SB pressurized by the pressurizing mechanism 265, the upper additional folding roller 261*a* and the lower additional folding roller 262*a* are moved in the width direction of the sheet bundle SB (in the direction indicated by an arrowed line D1 in FIG. 12) as described later to perform additional folding on the fold line portion SB1.

Figure 13:
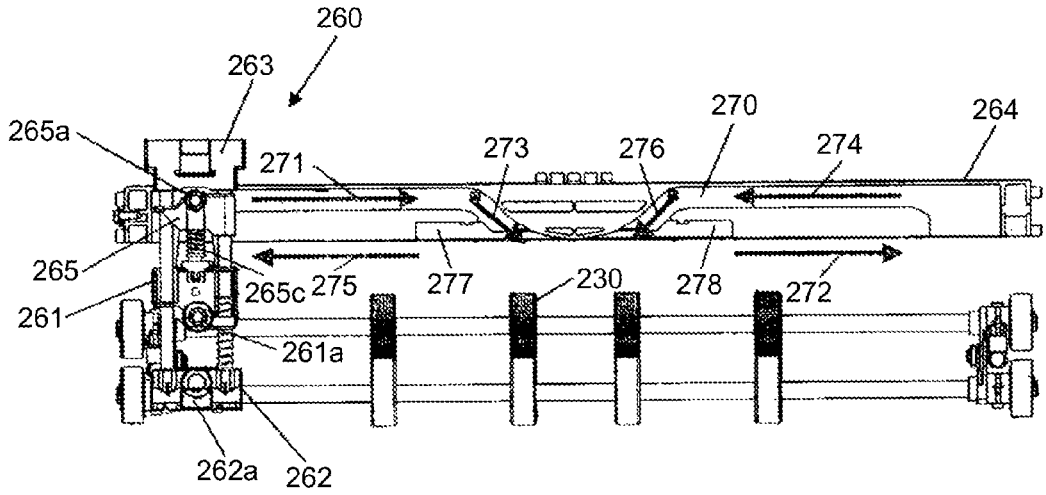
FIG. 13 is a diagram illustrating details of a guide member.

FIG. 13 is a diagram illustrating details of the guide member 264. The guide member 264 includes a guide path 270 that guides the additional folding roller unit 260 in the width direction of the sheet bundle SB. This guide path 270 is provided with six paths including a first guide path 271, a second guide path 272, a third guide path 273, a fourth guide path 274, a fifth guide path 275, and a sixth guide path 276.

The first guide path 271 is a path that guides the pressurizing mechanism 265 in the pressure-release state at the time of forward movement. The second guide path 272 is a path that guides the pressurizing mechanism 265 in the pressurizing state at the time of forward movement. The third guide path 273 is a path that switches the pressurizing mechanism 265 from the pressurizing state to the pressure-release state at the time of forward movement. The fourth guide path 274 is a path that guides the pressurizing mechanism 265 in the pressure-release state at the time of backward movement. The fifth guide path 275 is a path that guides the pressurizing mechanism 265 in the pressurizing state at the time of backward movement. The sixth guide path 276 is a path that switches the pressurizing mechanism 265 from the pressure-release state to the pressurizing state at the time of backward movement.

Figure 14:
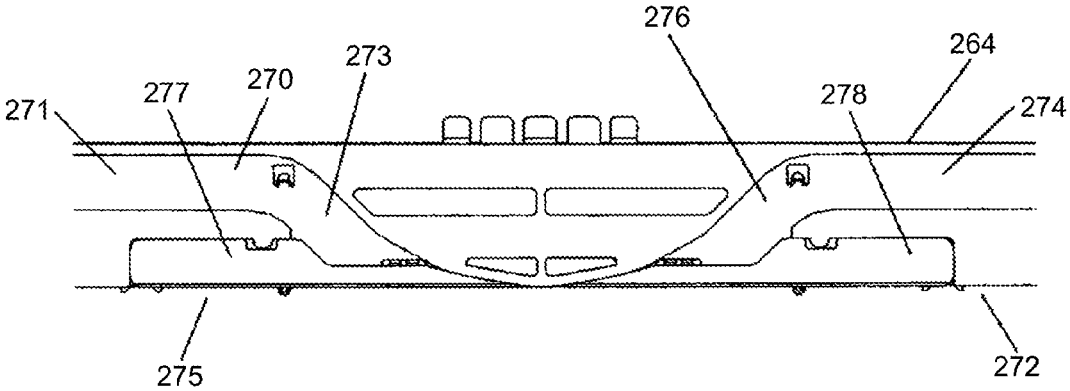
FIG. 14 is a diagram illustrating in a close-up manner the main part of FIG. 13 in the state in which a path switching claw has not been switched over.
Figure 15:
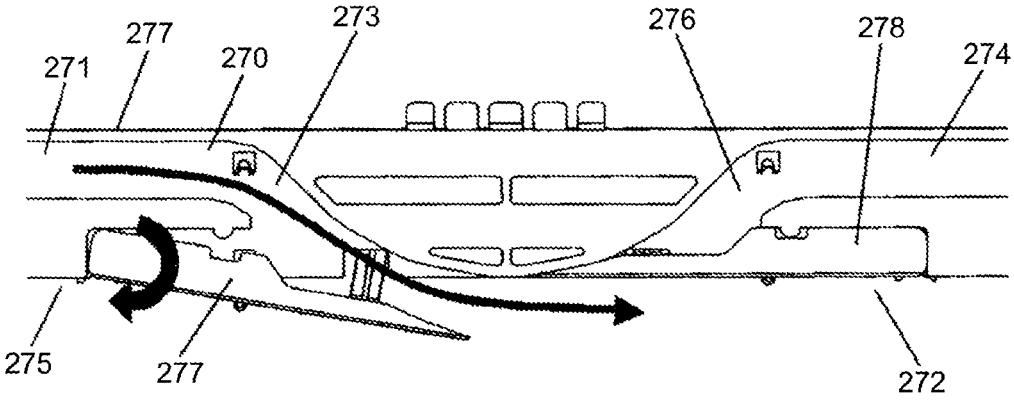
FIG. 15 is a diagram illustrating in a close-up manner the main part of FIG. 13 in the state in which a first path switching claw has been switched over.

FIGS. 14 and 15 are diagrams illustrating the main part of FIG. 13 in a close-up manner. It should be noted that an arrowed line in FIG. 15 indicates the moving locus of a guide pin 265*a* of the pressurizing mechanism 265.

As illustrated in FIGS. 14 and 15, a first path switching claw 277 is installed at the intersection between the third guide path 273 and the second guide path 272, and a second path switching claw 278 is installed at the intersection between the sixth guide path 276 and the fifth guide path 275.

The pressurizing mechanism 265 moves along the guide path 270 because the guide pin 265*a* of the pressurizing mechanism 265 is movably fitted in the guide path 270 in a loosely fitted state. In other words, the guide path 270 functions as a cam groove, and the guide pin 265*a* functions as a cam follower changing the position thereof while moving along this cam groove.

The first path switching claw 277 is pressed down from above by the guide pin 265*a* of the pressurizing mechanism 265 and thereby rotated to switch the guide path from the third guide path 273 to the second guide path 272, as illustrated in FIG. 15. Furthermore, the second path switching claw 278 is pressed down from above by the guide pin 265*a* of the pressurizing mechanism 265 and thereby rotated to switch the guide path from the sixth guide path 276 to the fifth guide path 275.

In contrast, switching the guide path from the second guide path 272 to the third guide path 273 cannot be performed by the first path switching claw 277, and switching the guide path from the fifth guide path 275 to the sixth guide path 276 cannot be performed by the second path switching claw 278. In other words, the first path switching claw 277 and the second path switching claw 278 are configured so as not to switch the guide paths in the reverse direction.

FIGS. 16 to 26 are operation explanatory diagrams illustrating the additional folding operation performed by the additional folding roller unit 260.

Figure 16:
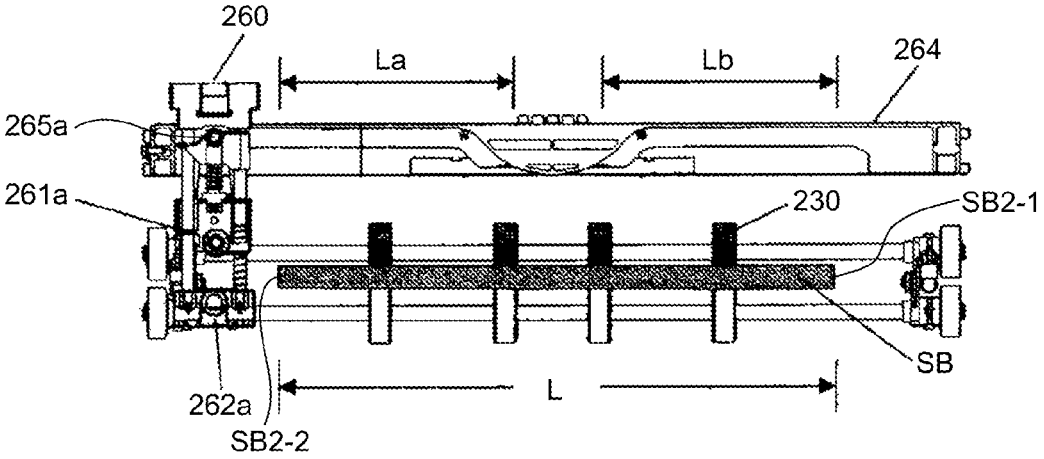
FIG. 16 is an operation explanatory diagram of the additional folding operations in the initial state.

FIG. 16 illustrates a state in which the sheet bundle SB folded by the pair of folding rollers 230 is carried to the additional folding position set in advance to be stopped and the additional folding roller unit 260 is in the waiting position. This position in this state is the initial position of the additional folding operation.

Figure 17:
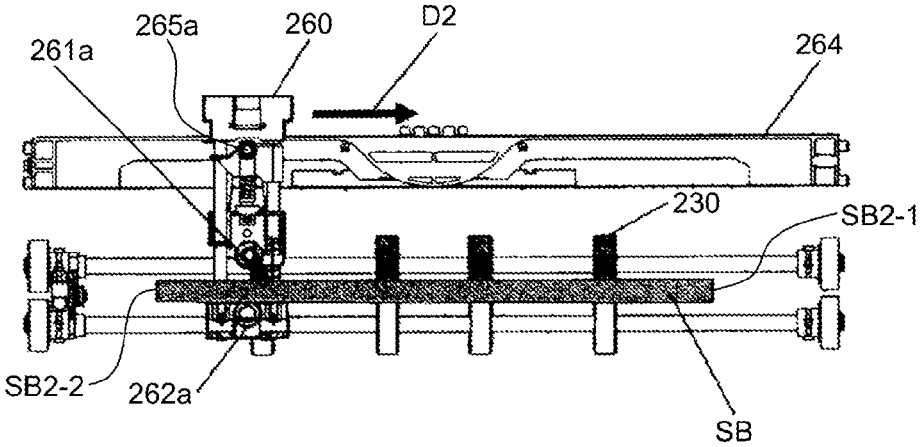
FIG. 17 is an operation explanatory diagram illustrating a state of the additional folding roller unit at the start of forward movement.

The additional folding roller unit 260 starts forward movement from the initial position illustrated in FIG. 16 to the right direction in FIG. 17 (in a direction indicated by an arrowed line D2), as illustrated in FIG. 17. During this operation, the pressurizing mechanism 265 in the additional folding roller unit 260 moves along the guide path 270 of the guide member 264 by the operation of the guide pin 265*a*, and after the start of the operation, moves along the first guide path 271. During this operation, the upper additional folding roller 261*a* and the lower additional folding roller 262*a* are in the pressure-release state.

The "pressure-release state" described above is a state in which the upper additional folding roller 261*a* and the lower additional folding roller 262*a* are in contact with the sheet bundle SB but almost no pressure is applied to the sheet bundle SB, or the upper additional folding roller 261*a* and the lower additional folding roller 262*a* are apart from the sheet bundle SB.

Figure 18:
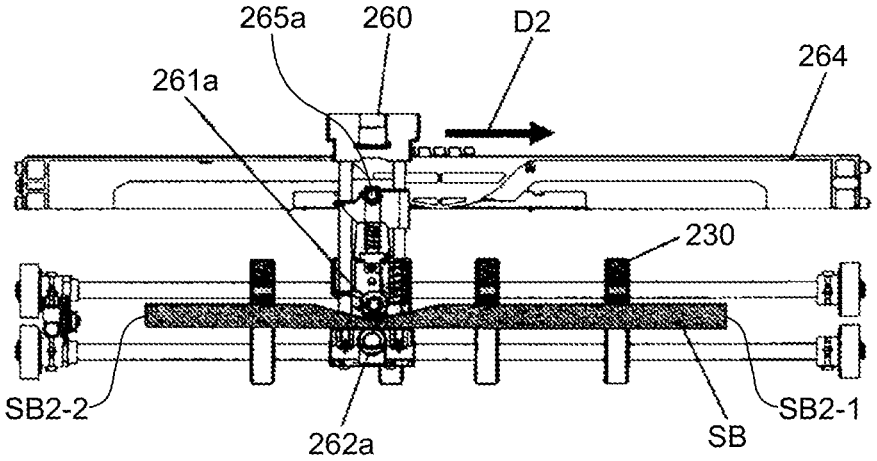
FIG. 18 is an operation explanatory diagram illustrating a state in which the vicinity of the center of the sheet bundle with the additional folding roller unit is reaching a third guide path.
Figure 19:
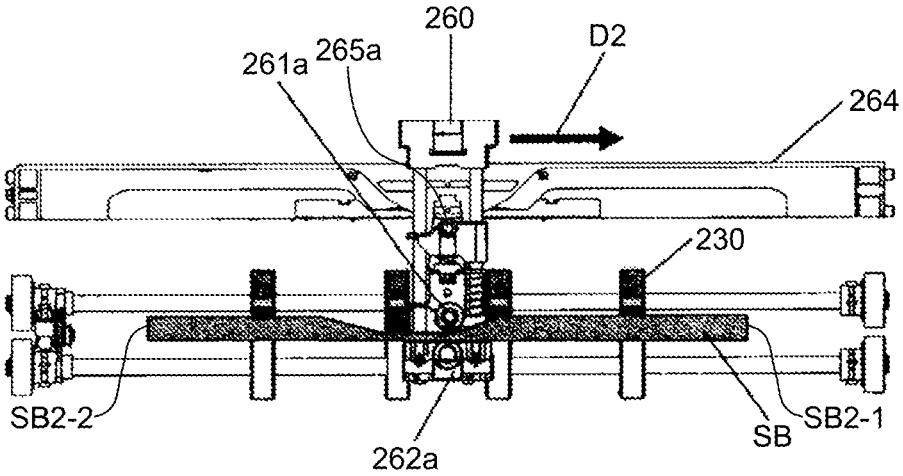
FIG. 19 is an operation explanatory diagram illustrating a state in which the additional folding roller unit is pushing away the first path switching claw to enter a second guide path.

When in the vicinity of the center of the sheet bundle SB the additional folding roller unit 260 reaches the third guide path 273 as illustrated in FIG. 18, the pressurizing mechanism 265 starts downward movement along the third guide path 273, and pushes away the first path switching claw 277 to enter the second guide path 272, as illustrated in FIG. 19. This operation causes the pressurizing mechanism 265 to pressurize the additional folding roller upper unit 261, which in turn abuts the sheet bundle SB, and the sheet bundle SB sandwiched by the upper additional folding roller 261*a* and the lower additional folding roller 262*a* starts to be pressurized.

Figure 20:
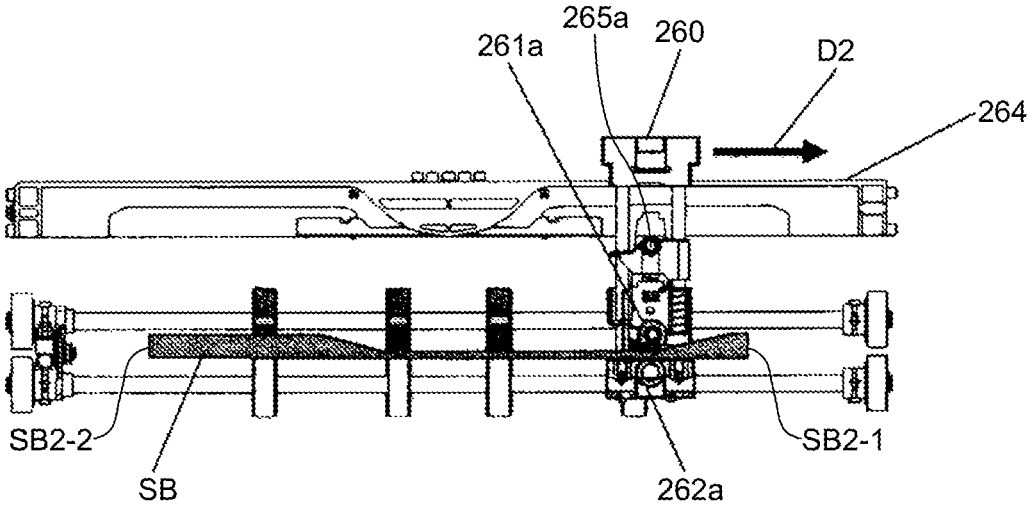
FIG. 20 is an operation explanatory diagram illustrating a state in which the additional folding roller unit is moving in the direction toward the end part while pressing the sheet bundle.
Figure 21:
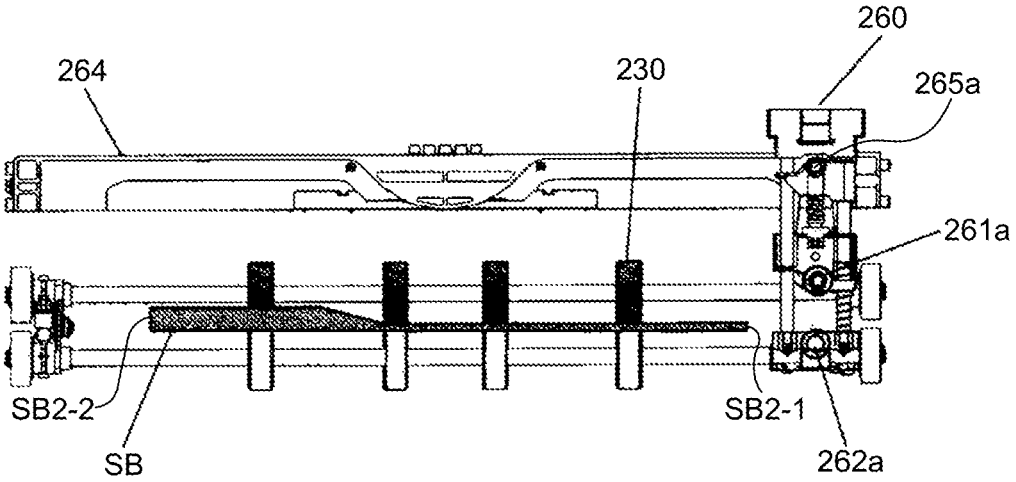
FIG. 21 is an operation explanatory diagram illustrating a state in which the additional folding roller unit has moved to the final position of forward movement along the second guide path.

With the sheet bundle SB pressurized as described above, the additional folding roller unit 260 is further moved to the direction indicated by the arrowed line D2 as illustrated in FIG. 20. Because the second path switching claw 278 cannot be moved in the reverse direction, the guide pin 265*a* of the pressurizing mechanism 265 is not guided to the sixth guide path 276, but is moved along the second guide path 272, and as shown in FIG. 21, the additional folding roller unit 260 passes the sheet bundle SB to be located in the final position of reciprocation.

After the additional folding roller unit 260 has moved as described above, the guide pin 265*a* of the pressurizing mechanism 265 moves from the second guide path 272 to the fourth guide path 274 in the upper part. As a result, the positional restriction of the guide pin 265*a* due to the upper surface of the second guide path 272 is released. The upper additional folding roller 261*a* is thus apart from the lower additional folding roller 262*a* to be in the pressure-release state.

Figure 22:
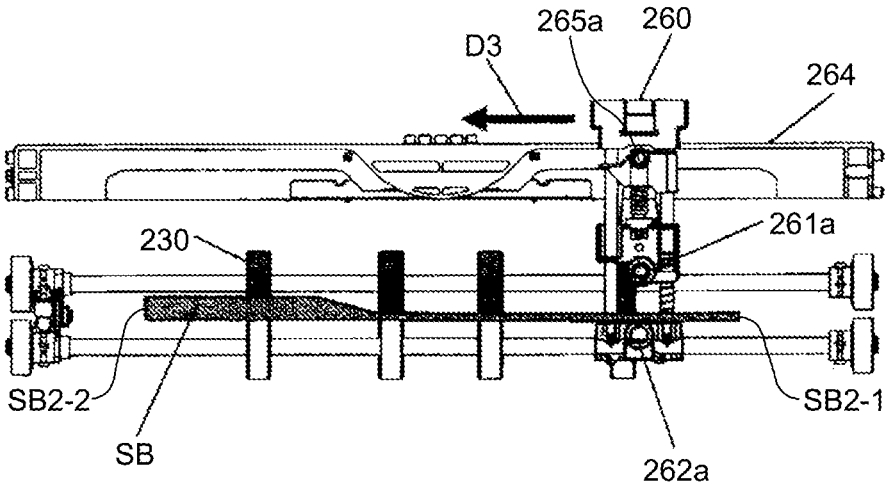
FIG. 22 is an operation explanatory diagram illustrating a state in which the additional folding roller unit has started backward movement from the final position of forward movement.
Figure 23:
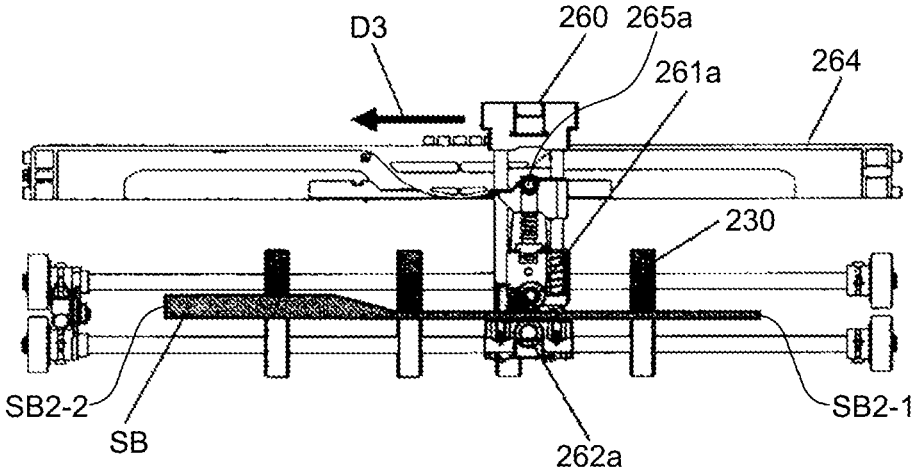
FIG. 23 is an operation explanatory diagram illustrating a state in which the additional folding roller unit has started backward movement and reached a sixth guide member.
Figure 24:
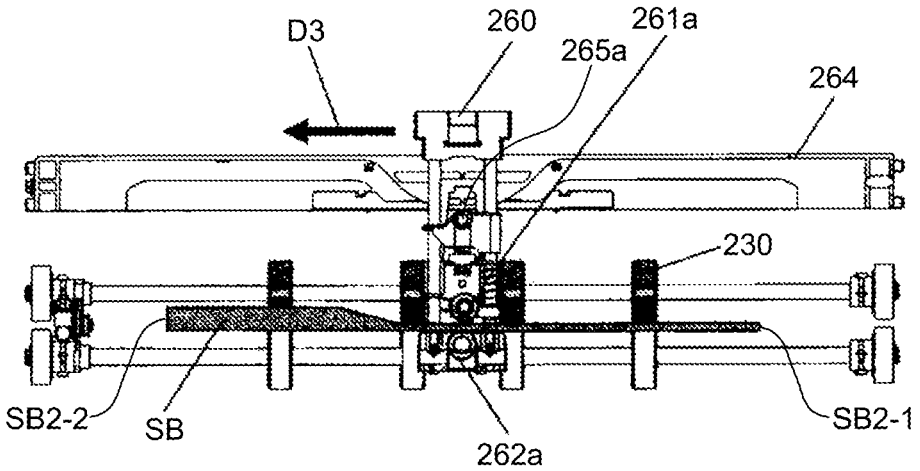
FIG. 24 is an operation explanatory diagram illustrating a state in which the additional folding roller unit has reached the sixth guide member and is moving from a pressure-release state to a pressing state.

The unit moving mechanism 263 then causes the additional folding roller unit 260 to start backward movement as illustrated in FIG. 22. In the backward movement, the pressurizing mechanism 265 moves in the leftward direction (a direction indicated by an arrowed line D3) in FIG. 22 along the fourth guide path 274. When the pressurizing mechanism 265 reaches the sixth guide path 276 by this movement as illustrated in FIG. 23, the second path switching claw 278 is pressed in the downward direction by the guide pin 265*a* along the shape of the sixth guide path 276. This operation causes the pressurizing mechanism 265 to shift from the pressure-release state to the pressurizing state as illustrated in FIG. 24.

Figure 25:
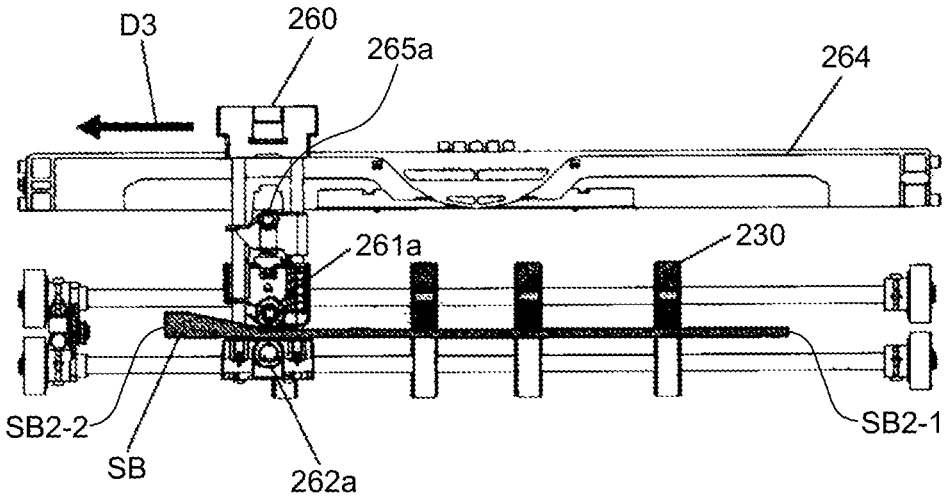
FIG. 25 is an operation explanatory diagram illustrating a state in which the additional folding roller unit has entered a fifth guide path and is in a complete pressing state.
Figure 26:
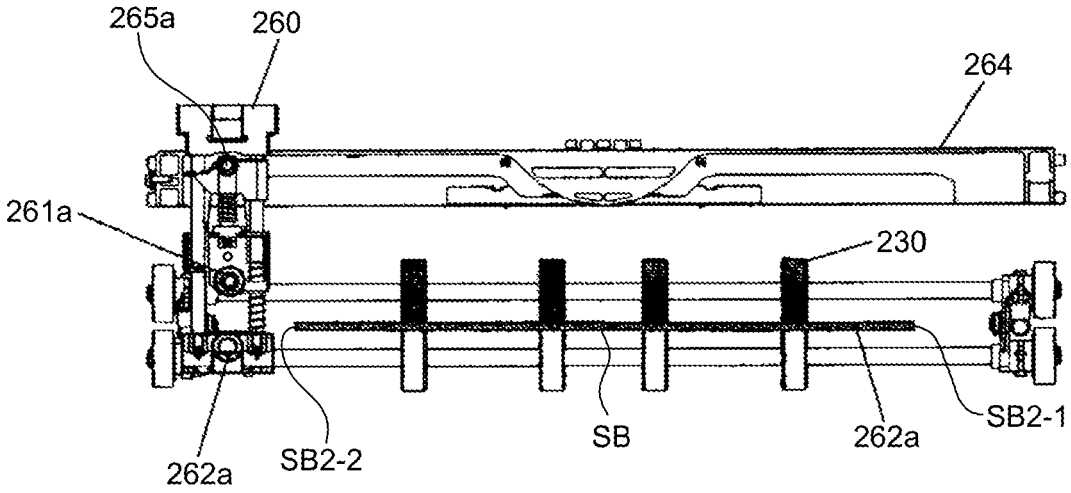
FIG. 26 is an operation explanatory diagram illustrating a state in which the additional folding roller unit has continued moving through the fifth guide path and returned to the home position.

Thereafter, when the additional folding roller unit 260 enters the fifth guide path 275 as illustrated in FIG. 25, the additional folding roller unit 260 is in a complete pressing state. The additional folding roller unit 260 then continues to move through the fifth guide path 275 in the direction indicated by the arrowed line D3 in FIG. 25 to pass the sheet bundle SB through as illustrated in FIG. 26.

As described above, the additional folding roller unit 260 is reciprocated in the guide path 270, whereby additional folding is performed on the sheet bundle SB. This additional folding operation is started from the center portion of the sheet bundle SB to one end SB2-1 of the sheet bundle SB, and the additional folding roller unit 260 passes through the one end SB2-1. Thereafter, the additional folding roller unit 260 is caused to move over the additionally folded sheet bundle SB, start additional folding from the center portion to the other end SB2-2 of the sheet bundle SB, and pass through the other end SB2-2, thereby the additional folding operation is completed.

If the additional folding operation is executed as described above, when the additional folding roller unit 260 starts additional folding or when the additional folding unit returns to the other end SB2-2 after passing through the one end SB2-1 of the sheet bundle SB, the upper additional folding roller 261*a* and the lower additional folding roller 262*a* will not contact or press the ends SB2-1, SB2-2 of the sheet bundle SB from the outside of the sheet bundle SB. In other words, when the additional folding roller unit 260 passes the ends SB2-1, SB2-1 of the sheet bundle SB through from the outside thereof, the additional folding roller unit 260 is in the pressure-release state. The ends SB2-1, SB2-2 of the sheet bundle SB are thus free from any damage.

Furthermore, because the additional folding roller unit 260 performs additional folding from the vicinity of the center portion of the sheet bundle SB to the ends SB2-1, SB2-2 thereof, the running distance of the additional folding rollers 261*a*, 262*a* in contact with the sheet bundle SB subjected to additional folding is short, which makes it possible to cut out accumulation of kinking that causes crinkling, for example. This operation can thus control generation of turning up and crinkling on and in the vicinity of the fold line portion SB1 due to accumulation of kinking, because these operations cause no damage on the ends SB2-1, SB2-2 of the sheet bundle SB while the fold line portion SB1 of the sheet bundle SB is additionally folded.

In order to prevent the upper additional folding roller 261*a* and the lower additional folding roller 262*a* from running on the ends of the sheet bundle SB from outside thereof, the relation described below should be satisfied. That is to say, as can be seen from the operations illustrated in FIGS. 16 to 26, assume that the moving distance of the additional folding roller unit 260 over the sheet bundle SB in the pressure-release state during forward movement is La, and the moving distance of the additional folding roller unit 260 over the sheet bundle SB in the pressure-release state during backward movement is Lb. The relation between the length L in the width direction of the sheet bundle SB and the distances La and Lb must be $L>La+Lb$ (FIGS. 16 to 18 and 21 to 23).

Furthermore, it is preferable that the distances La and Lb are set to approximately the same and the pressurization is started in the vicinity of the center portion of the sheet bundle SB in the width direction (FIGS. 20 and 24).

The additional folding roller unit 260 in the present embodiment is provided with the additional folding roller lower unit 262 and performs additional folding with the upper additional folding roller 261*a* and the lower additional folding roller 262*a* sandwiching the sheet bundle SB. However, the additional folding roller unit 260 may be provided with the additional folding roller upper unit 261 and a receiving member (not illustrated) including an abutting surface opposing the additional folding roller upper unit 261 instead of the additional folding roller lower unit 262, and configured to pressurize the sheet bundle SB between the additional folding roller upper unit 261 and the receiving member.

Furthermore, in the additional folding roller unit 260 in the present embodiment, the additional folding roller upper unit 261 is configured to be movable in the vertical direction and the additional folding roller lower unit 262 is configured to be non-movable in the vertical direction. However, the present invention is not limited thereto. More specifically, the additional folding roller lower unit 262 can also be configured to be movable in the vertical direction. With this configuration, the upper additional folding roller 261*a* and the lower additional folding roller 262*a* come into and out of contact with each other symmetrically relative to the additional folding position. The additional folding position can be thus fixed irrespective of the thickness of the sheet bundle SB, and any damage such as a scratch can be further prevented.

The characterizing parts of the saddle-stitching bookbinding apparatus 2 according to the present embodiment will be next described.

Figure 27:
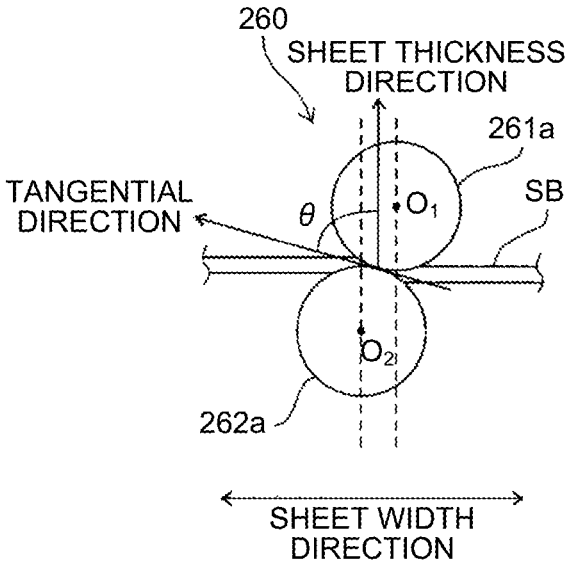
FIG. 27 is a diagram used for explanation of positional relation between an upper additional folding roller and a lower additional folding roller.

In the additional folding roller unit 260 in the present embodiment, the upper additional folding roller 261*a* and the lower additional folding roller 262*a* are disposed in a manner that the rollers are displaced each other in the sheet width direction, as illustrated in FIG. 27. More specifically, the upper additional folding roller 261*a* and the lower additional folding roller 262*a* are shifted such that the position of the shaft center $O_1$ of the upper additional folding roller 261*a* and the position of the shaft center $O_2$ of the lower additional folding roller 262*a* are shifted each other in the sheet width direction. Furthermore, in the present embodiment, when it is assumed that the tangential direction of the rollers 261*a* and 262*a* is indicated by the tangential line at the touch point between the upper additional folding roller 261*a* and the lower additional folding roller 262*a*, and the angle of the line segment of the tangential direction formed from the line segment of the sheet thickness direction is indicated as θ (degree), the angle θ satisfies 0[°]<θ<90[°].

Disposing the upper additional folding roller 261*a* and the lower additional folding roller 262*a* in a manner that the rollers 261*a* and 262*a* are shifted in the sheet width direction thus enables the folding operation where the sheet bundle SB is contacting onto each additional folding roller as winding to the rollers, whereby the folding force can be increased. This further shortens the distance between the shafts of the upper additional folding roller 261*a* and the lower additional folding roller 262*a* in the height direction of the additional folding unit 260. The size of the apparatus can be reduced by the shortened distance.

Figure 28:
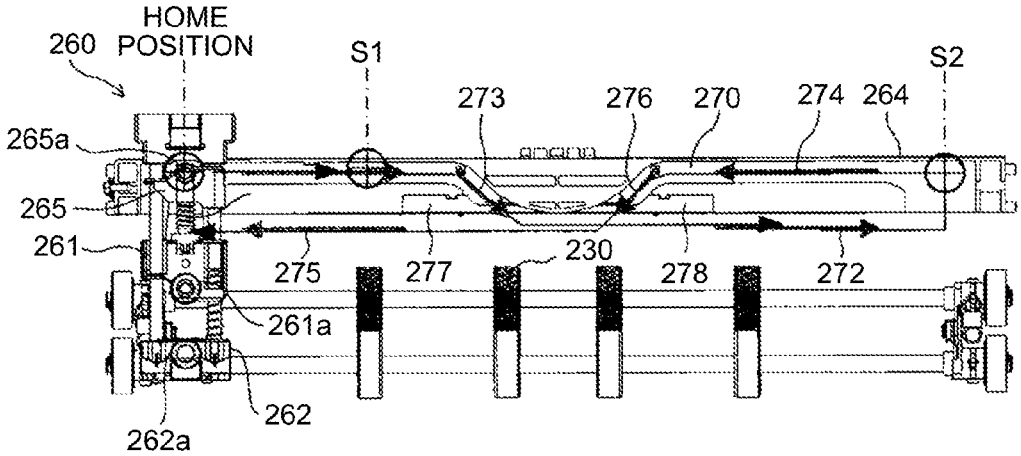
FIG. 28 is an explanatory diagram of points based on which the additional folding roller unit in an additional folding mechanism moves in accordance with a unit moving mechanism.

FIG. 28 is an explanatory diagram of points based on which the additional folding roller unit 260 in an additional folding mechanism moves in accordance with the unit moving mechanism 263. Symbol S1 in FIG. 28 indicates the position where the additional folding roller unit 260 waits before moving from the home position thereof to start additional folding of the sheet bundle SB. Symbol S2 in FIG. 28 indicates the position where the moving direction directed by the unit moving mechanism 263 is switched and the movement is started in the leftward direction in FIG. 28.

Figure 29:
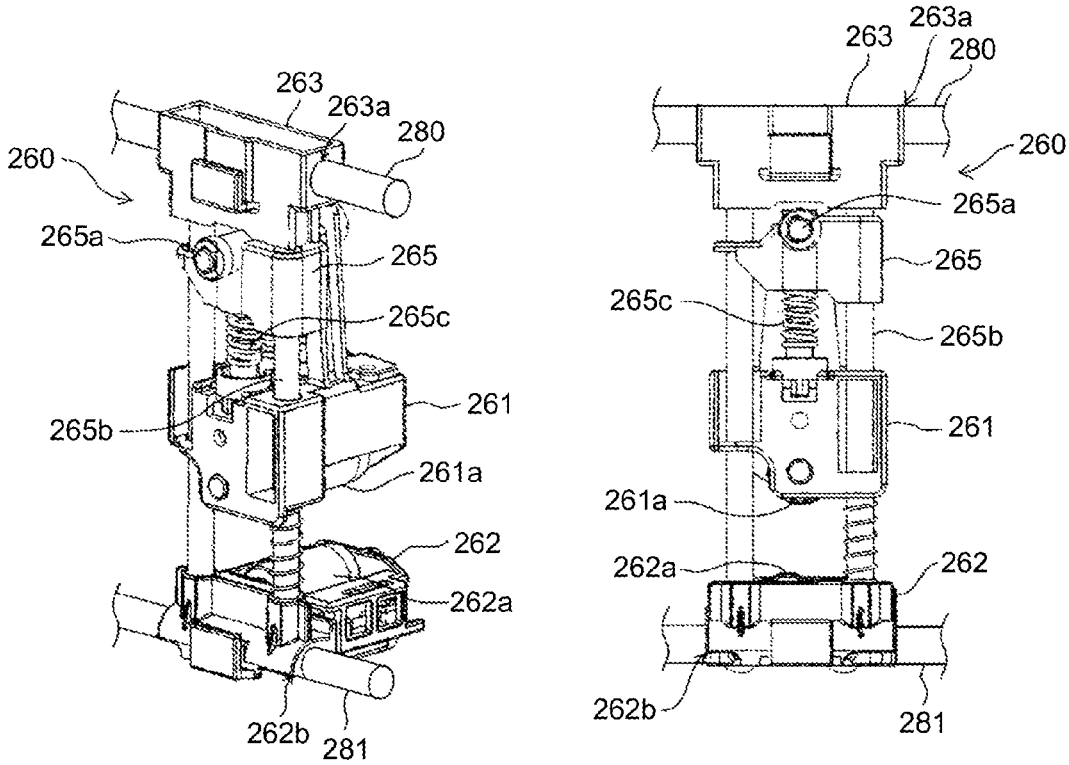
FIG. 29 is a detailed explanatory diagram of the additional folding roller unit.

FIG. 29 is a detailed explanatory diagram of the additional folding roller unit 260. In the additional folding roller unit 260, the unit moving mechanism 263 is provided with a joint 263*a* that is fitted with a guide shaft 280 and the additional folding roller lower unit 262 is provided with a joint 262*b* that is fitted with a guide shaft 281. A driving unit (not illustrated) including an additional folding motor and a gear, for example, is also provided so that the additional folding roller unit 260 can move in the sheet width direction along the guide shafts 280 and 281.

The force required to move the additional folding roller unit 260 in the operation described above will be larger than the friction force F that is generated between the joint 263*a* of the unit moving mechanism 263 and the guide shaft 280. This friction force F will depend on the load reaction force P of the pressing spring 265*c* that is applied on the joint 263*a* of the unit moving mechanism 263. This is represented by Equation (1) below.

$$F=P\times\mu \quad (1)$$

(where P is the load reaction force of the pressing spring 265*c* applied on the joint 263*a* of the unit moving mechanism 263, and μ is the friction coefficient between the joint 263*a* of the unit moving mechanism 263 and the guide shaft 280.)

Figure 30:
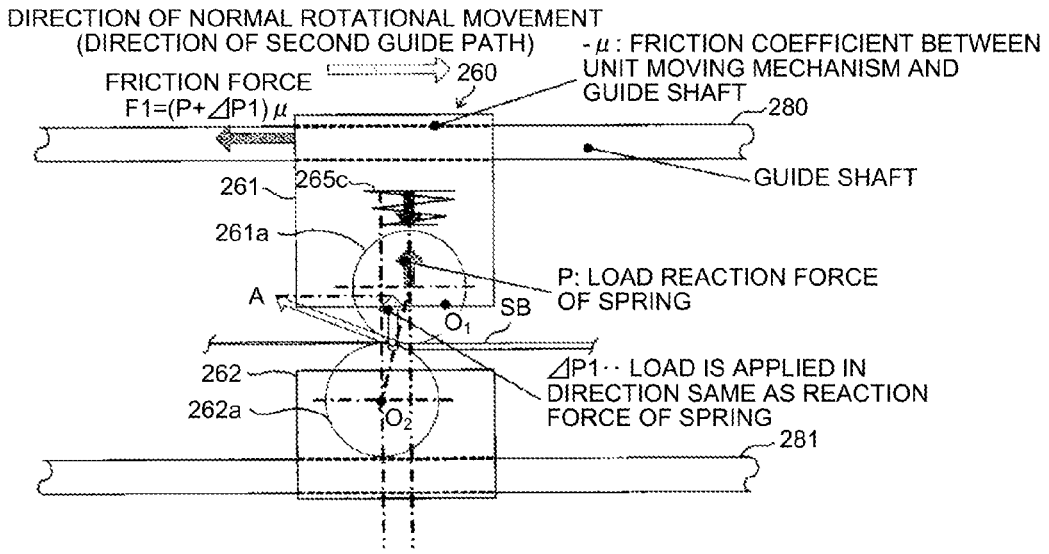
FIG. 30 is an explanatory diagram illustrating the additional folding roller unit moved in the direction of normal rotational movement.

FIG. 30 is an explanatory diagram illustrating the additional folding roller unit 260 moved in the direction of normal rotational movement.

When the additional folding roller unit 260 is moved in the direction that the upper additional folding roller 261*a* precedes (the direction of normal rotational movement) in the movement thereof in the sheet width direction, the upper additional folding roller 261*a* is pressed downward by the pressing spring 265*c*. In this operation, because the upper additional folding roller 261*a* precedes the lower additional folding roller 262*a*, a force is generated for the upper additional folding roller 261*a* to run up in a direction indicated by an arrowed line A illustrated in FIG. 30. A vertical load is thus applied on the upper additional folding roller 261*a* in a direction indicated by an arrowed line of ΔP1 in FIG. 30.

This means that the friction force F1 generated between the joint 263*a* of the unit moving mechanism 263 and the guide shaft 280 while the additional folding roller unit 260 is moved in the direction of normal rotational movement will satisfy the relation represented by Equation (2).

$$\text{Friction force } F1=(P+\Delta P1)\mu \quad (2)$$

Figure 31:
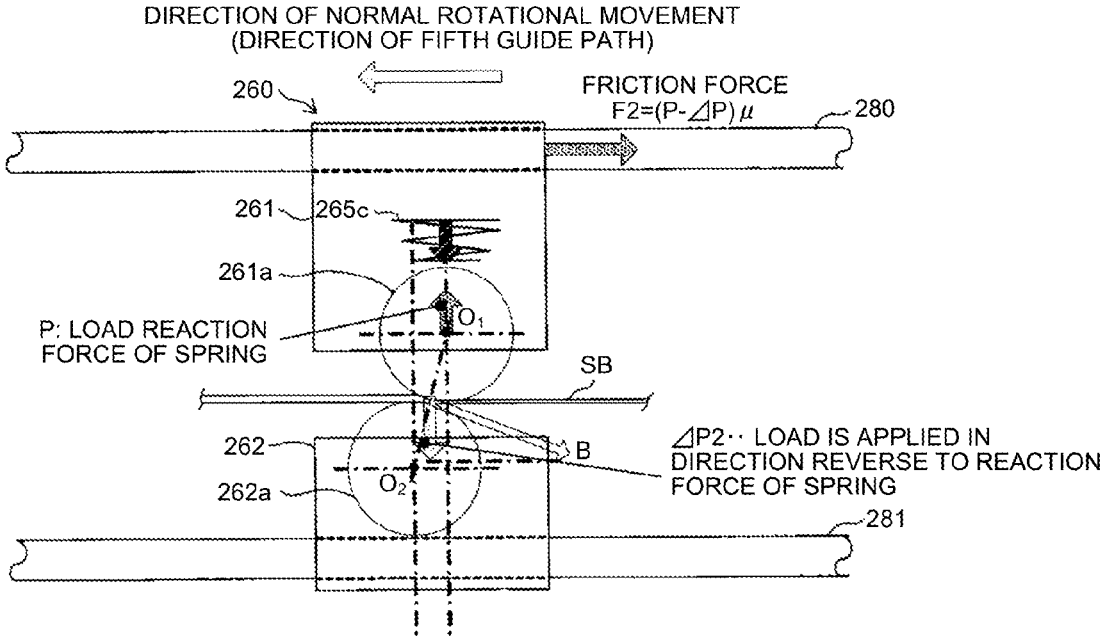
FIG. 31 is an explanatory diagram illustrating the additional folding roller unit moved in the direction of reverse rotational movement.

FIG. 31 is an explanatory diagram illustrating the additional folding roller unit 260 moved in the direction of reverse rotational movement, which is reverse of the direction illustrated in FIG. 30.

In this operation, the lower additional folding roller 262*a* precedes when the additional folding roller unit 260 is moved in the sheet width direction. Although the upper additional folding roller 261*a* is pressed downward by the pressing spring 265*c*, a force lowering the upper additional folding roller 261*a* is generated in the direction indicated by an arrowed line B in FIG. 31, because the lower additional folding roller 262*a* precedes the upper additional folding roller 261*a*. For this reason, a load applied in the vertical direction relative to the upper additional folding roller 261*a* is applied in a direction of ΔP2 (reverse to the load reaction force P of the pressing spring 265*c*) marked with an arrowed line in FIG. 31.

This means that the friction force F2 generated between the joint 263*a* of the unit moving mechanism 263 and the guide shaft 280 while the additional folding roller unit 260 is moved in the direction of reverse rotational movement will satisfy the relation represented by Equation (3).

$$\text{Friction force } F2=(P-\Delta P2)\mu \quad (3)$$

When the friction forces F1 and F2 are compared in magnitude from Equations (2) and (3), the relation represented by Equation (4) will be satisfied.

$$F1=(P+\Delta P1)\mu>F2=(P-\Delta P2)\mu \quad (4)$$

F1>F2

Equation (4) indicates that moving the additional folding roller unit 260 in the direction of normal rotational movement as illustrated in FIG. 30 generates a higher moving load than moving the additional folding roller unit 260 in the direction of reverse rotational movement as illustrated in FIG. 31.

First Configuration Example

Figure 32:
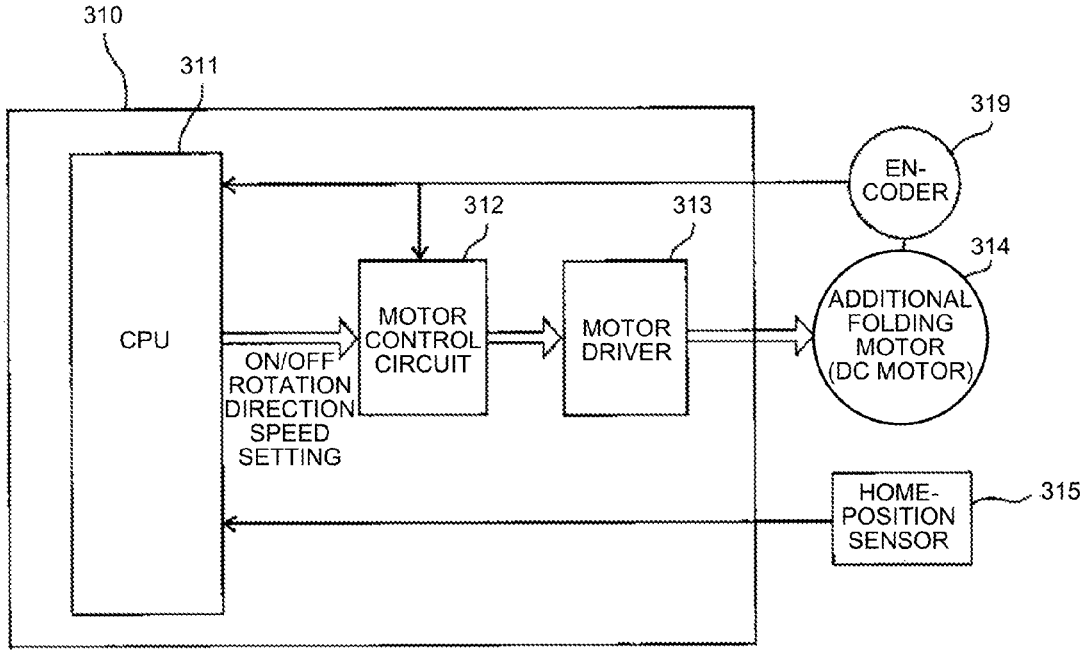
FIG. 32 is a block diagram related to drive control of an additional folding roller unit according to the first configuration example.

FIG. 32 is a block diagram related to drive control of the additional folding roller unit 260. This will be explained using an example in which an additional folding motor 314 that is a DC motor is used for moving the unit moving mechanism 263.

The driving control of the additional folding roller unit 260 is performed by a CPU 311 controlling the additional folding motor 314 through a motor control circuit 312 and a motor driver 313. For this control, servo control is performed under which a signal from an encoder 319 attached to the shaft of the additional folding motor 314 is fed back to enable fixed speed driving. Furthermore, the position of the additional folding roller unit 260 is recognized with the pulse of the signal from the encoder counted. It is configured that the signal of the home-position sensor 315 that is an optical sensor detecting the home position of the additional folding roller unit 260 is directly input into the CPU 311.

Figure 1:
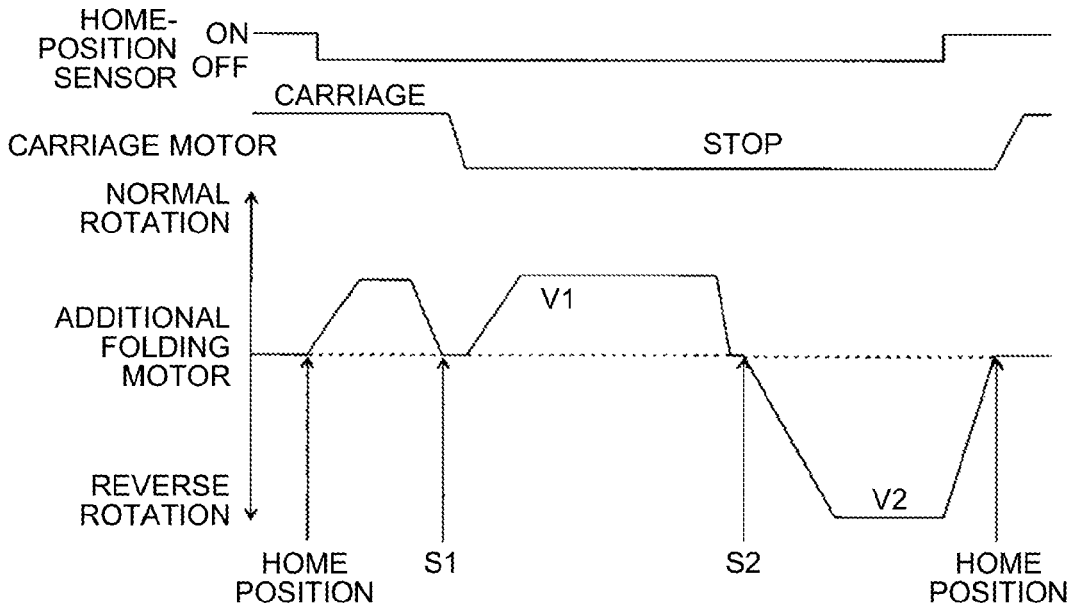
FIG. 1 is a timing chart for explaining a series of additional folding operations of a sheet bundle performed by an additional folding roller unit according to a first configuration example.

FIG. 1 is a timing chart for explaining a series of additional folding operations of the sheet bundle SB performed by the additional folding roller unit 260.

The additional folding roller unit 260 is moved from the home position thereof to the waiting position S1 at a predetermined timing to be stopped and wait. It should be noted that the moving speed for this operation is not particularly specified. When the pair of folding rollers 230 is rotated by a carriage motor (not illustrated) to carry the sheet bundle SB and the fold line portion of the sheet bundle SB reaches to the position where the sheet bundle SB is additionally folded by the additional folding roller unit 260, the carriage of the sheet bundle SB is stopped. For the start of additional folding performed by the additional folding roller unit 260, the additional folding motor 314 is controlled at the speed V1 and the additional folding roller unit 260 starts forward movement. The additional folding motor 314 is driven in reverse rotation in the position S2 where the additional folding roller unit 260 starts backward movement, and controlled at the speed V2. It should be noted that the speed V1 and the speed V2 satisfy the relation in which the speed V1<the speed V2.

The additional folding roller unit 260 performs additional folding of the sheet bundle SB in the backward movement at the speed V2, and is then stopped at the point where the home position thereof is detected by the output from the home-position sensor 315, completing the additional folding operation.

Because high load is applied in the first movement in the direction of normal rotational movement, the speed is set to V1 (low speed) with consideration for the torque generated by the additional folding motor 314 so that the required torque will be generated. On the contrary, because the load is decreased at the time of movement in the direction of reverse rotational movement, less torque is required than in forward movement. In the movement in the direction of reverse rotational movement, the additional folding motor 314 is thus driven at V2 (high speed). Because the additional folding roller unit 260 is driven at a speed suitable for the required torque as described above, the time required for a series of additional folding operations can be minimized, whereby the productivity is improved.

The required torque also depends on the thickness (basis weight) and the number of the sheets. As the thickness (basis weight) and the number of the sheets get larger, more torque will be required for moving the additional folding roller unit 260.

Figure 33:
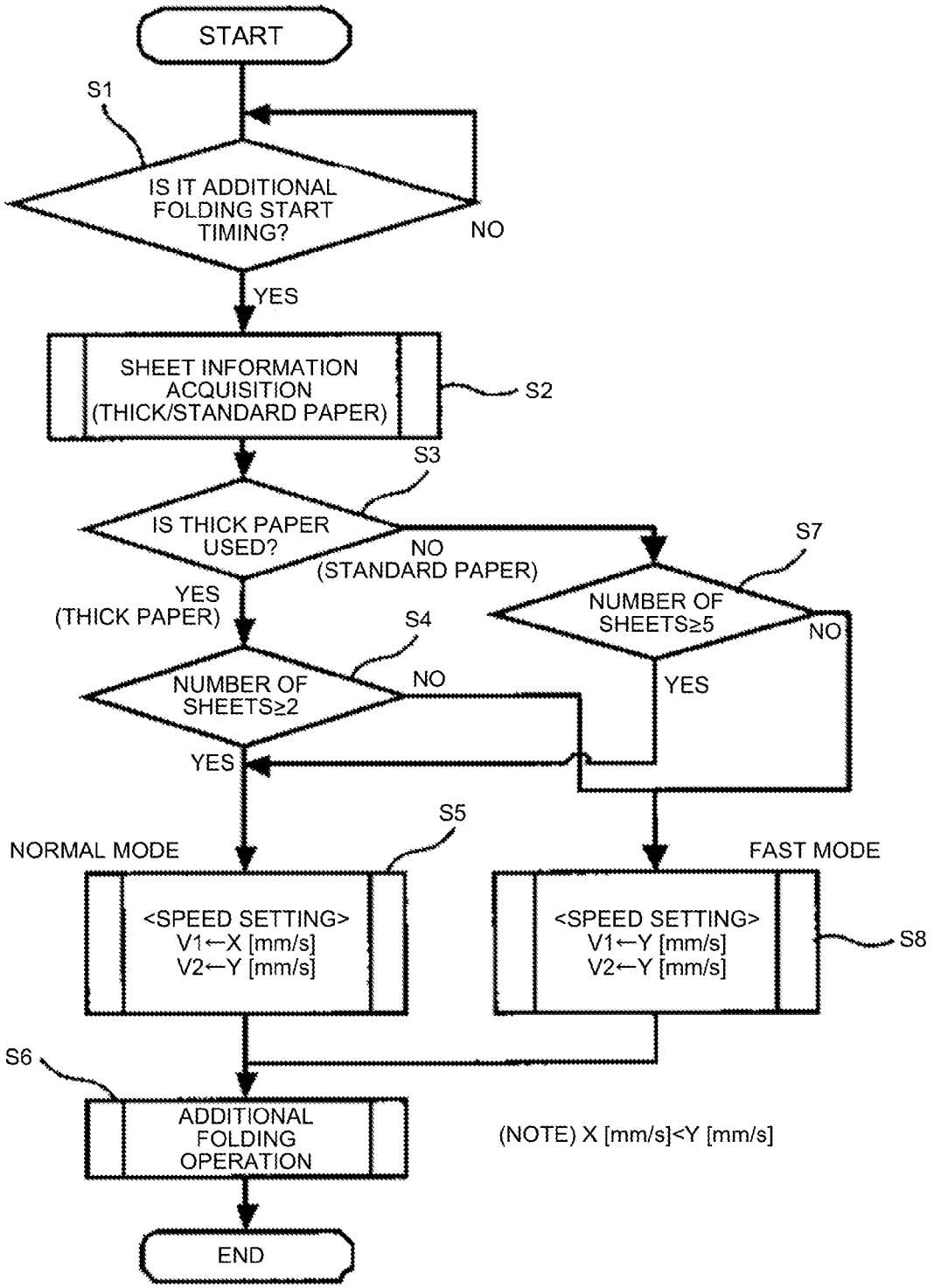
FIG. 33 is a flowchart illustrating an example of changing speed settings based on conditions such as the thickness (basis weight) and the number of sheets.
Figure 34:
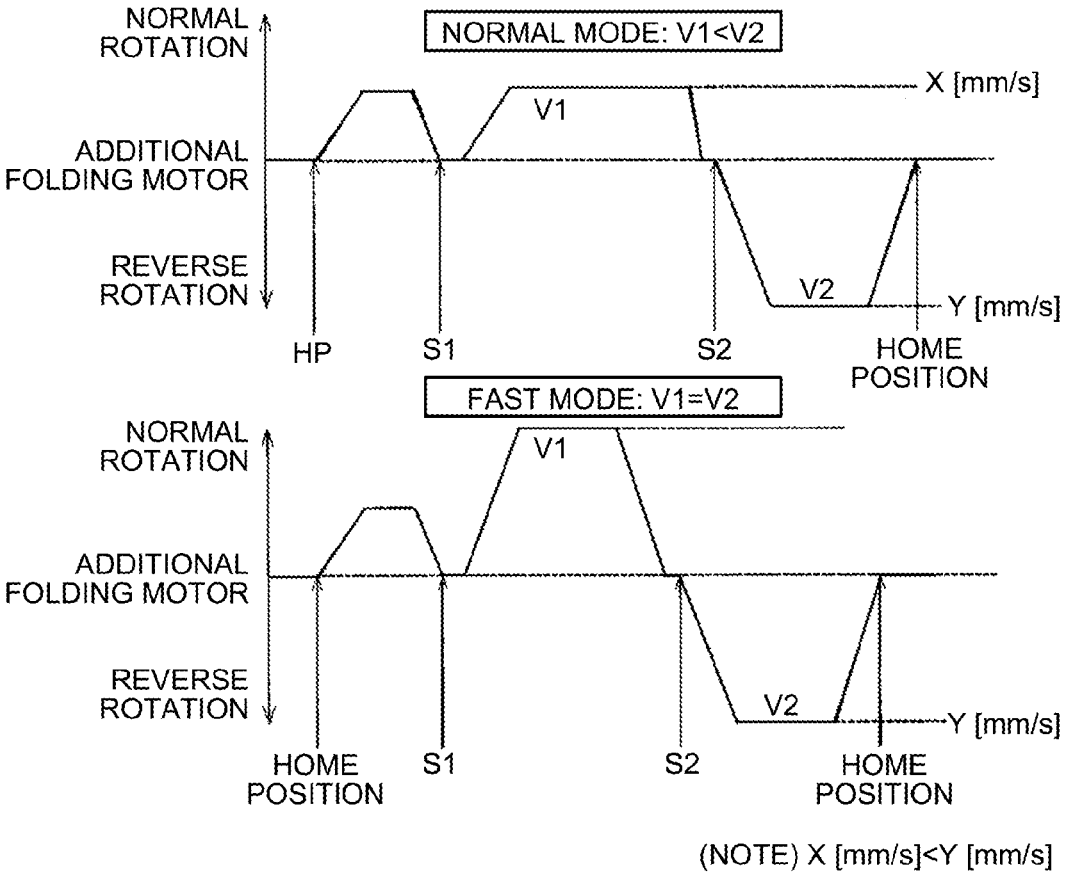
FIG. 34 is a timing chart for explaining a speed setting based on the movement direction of an additional folding roller unit 260 in a normal mode and a fast mode.

FIG. 33 is a flowchart illustrating an example of changing speed settings based on conditions such as the thickness (basis weight) and the number of the sheets. FIG. 34 is a timing chart for explaining a speed setting based on the movement direction of the additional folding roller unit 260 in a normal mode and a fast mode.

The CPU 311 illustrated in FIG. 32 acquires information of the sheets used at the timing of the additional folding start (Yes at Step S1) from the apparatus body (Step S2).

In this example, if the sheets are thick paper (Yes at Step S3) and the number of sheets contained in the sheet bundle SB is two or more (Yes at Step S4), the moving load of the additional folding roller unit 260 is high. If the sheets are standard paper (No at Step S3) and the number of sheets contained in the sheet bundle SB is five or more (Yes at Step S7), the moving load of the additional folding roller unit 260 is similarly high. For the cases described above, the speed setting is performed in the normal mode. Specifically, V1=X [mm/s], V2=Y [mm/s], (X<Y) is specified in the speed setting for the normal mode (Step S5).

It should be noted that the speed V1 in the moving direction in which the load is high is set to the lower speed X [mm/s], and the speed V2 in the moving direction in which the load is low is set to the speed Y [mm/s] higher than the speed V1.

On the contrary, if the sheets are thick paper and the number of sheets contained in the sheet bundle SB is one (No at step S4) and if the sheets are standard paper and the number of sheets contained in the sheet bundle SB is four or less (No at Step S7), the load influence of the sheet bundle SB is decreased. In such cases, the speed setting is performed in the fast mode. Specifically, V1=Y [mm/s], V2=Y [mm/s] is specified in the speed setting for the fast mode (Step S8).

It should be noted that the speeds are set to Y [mm/s] in the fast mode for both movement directions. With this, the productivity can be improved.

After the speed setting is performed either in the normal mode or in the fast mode as described above, the additional folding operation is performed by the additional folding roller unit 260 (Step S6), whereby the control in series is completed.

Furthermore, when changing the operation mode either to the normal mode or the fast mode based on a predetermined condition of this sheet information, the permission for the change can be set by the user optionally.

Figure 35:
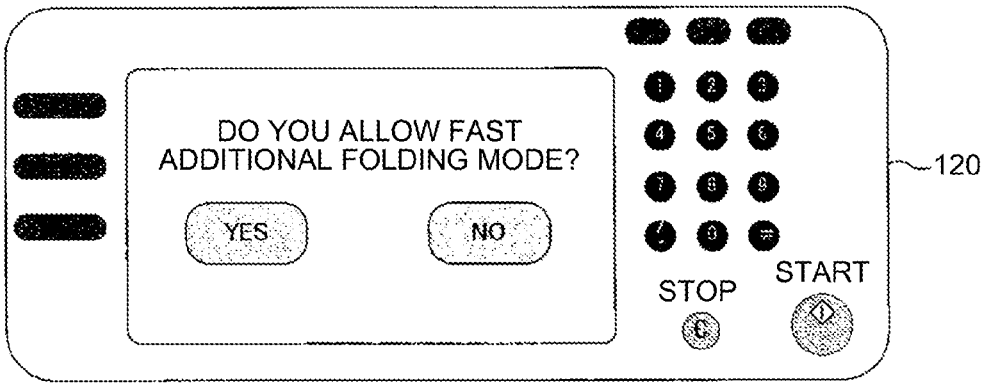
FIG. 35 is an explanatory diagram illustrating selection made by a user on whether or not to allow a fast additional folding mode on an operation panel of the image forming apparatus.

For example, an operation panel 120 of the image forming apparatus 3, to which the saddle-stitching bookbinding apparatus 2 is connected, may be used for selecting between the normal mode and the fast mode by the user selecting whether to allow the fast additional folding mode, as illustrated in FIG. 35. The information selected on the operation panel 120 is then transmitted from a controller (not illustrated) in the image forming apparatus 3 to a controller 310 in the saddle-stitching bookbinding apparatus 2 through serial communication, determining if the CPU 311 changes the operation mode.

Second Configuration Example

Figure 36:
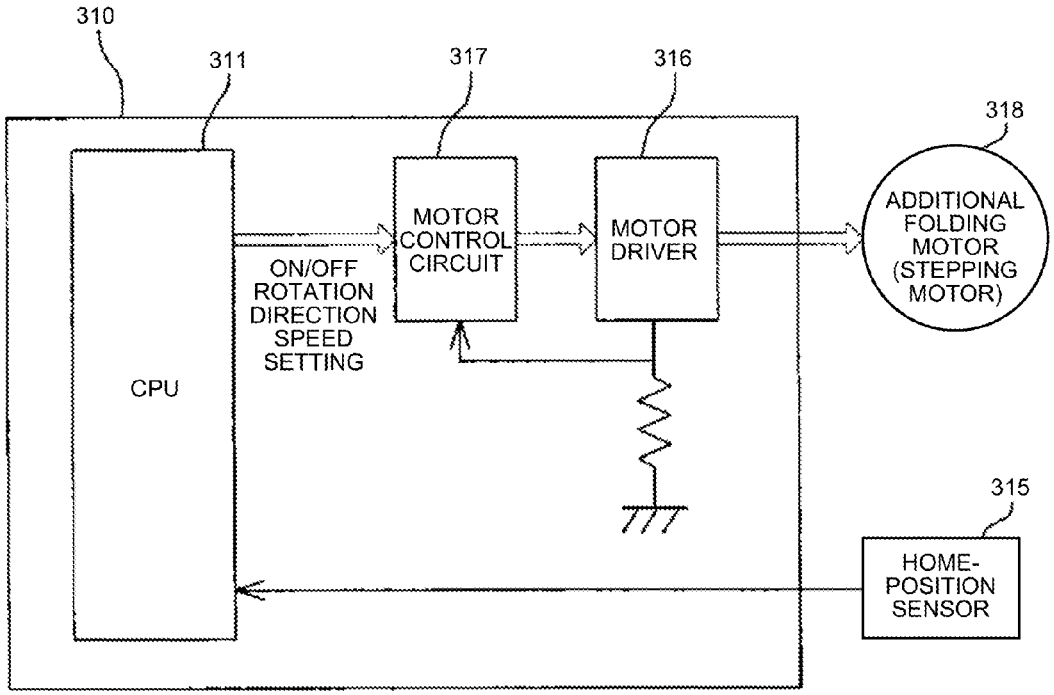
FIG. 36 is a block diagram related to drive control of an additional folding roller unit according to a second configuration example.

FIG. 36 is a block diagram related to drive control of the additional folding roller unit 260. This will be explained using an example in which an additional folding motor 318 that is a stepping motor is used for moving the unit moving mechanism 263.

The drive control of the additional folding roller unit 260 is performed with the CPU 311 controlling the additional folding motor 318 through a motor control circuit 317 and a motor driver 316. This control is performed such that the current value for the current supplied to the additional folding motor 318 is fed back as a signal and the additional folding motor 318 is driven at a constant current. Furthermore, the position of the additional folding roller unit 260 is acknowledged with a motor drive clock counted. It is configured that the signal of the home-position sensor 315 that is an optical sensor detecting the home position of the additional folding roller unit 260 is directly input into the CPU 311.

Figure 37:
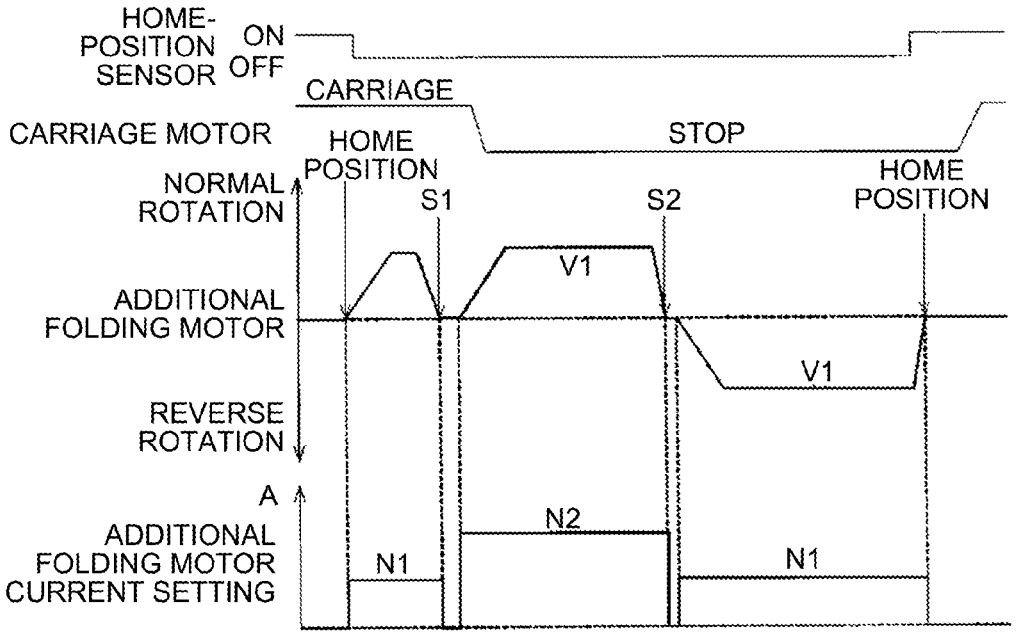
FIG. 37 is a timing chart for explaining a series of additional folding operations of a sheet bundle performed by the additional folding roller unit according to the second configuration example.

FIG. 37 is a timing chart for explaining a series of additional folding operations of the sheet bundle SB performed by the additional folding roller unit 260.

The additional folding roller unit 260 is moved from the home position thereof to the waiting position S1 at a predetermined timing to be stopped and wait. It should be noted that the set motor current is not particularly specified. When the pair of folding rollers 230 is rotated by a carriage motor (not illustrated) to carry the sheet bundle SB and the fold line portion of the sheet bundle SB reaches the position where the sheet bundle SB is additionally folded by the additional folding roller unit 260, the carriage of the sheet bundle SB is stopped. For the start of additional folding performed by the additional folding roller unit 260, the additional folding motor 318 is controlled at the set motor current N2 and the additional folding roller unit 260 starts movement in the direction of normal rotational movement (forward movement). The additional folding motor 318 is driven in reverse rotation in the position S2 where the additional folding roller unit 260 starts backward movement, and controlled at the set motor current N1. It should be noted that the set motor current N1 and the set motor current N2 satisfy the relation in which the set motor current N1 is lower than the set motor current N2.

The additional folding roller unit 260 performs additional folding of the sheet bundle SB in the direction of reverse rotational movement (backward movement), and then stopped at the point where the home position thereof is detected by the output from the home-position sensor 315, completing the additional folding operation.

Because high load is applied in the first movement in the direction of normal rotational movement, the set motor current is set to N2 (high current) with consideration for the torque generated by the additional folding motor 318 so that the required torque will be generated. On the contrary, because the load is decreased at the time of movement in the direction of reverse rotational movement as explained above, less torque is required than in forward movement. In the movement in the direction of reverse rotational movement, the additional folding motor 318 is thus driven at N1 (low current). Because the additional folding roller unit 260 is driven by the additional folding motor 318 at a speed suitable for the required torque as described above, the energy for a series of additional folding operations performed by the additional folding roller unit 260 can be optimized, whereby the energy saving performance is improved.

As described above, the required torque also depends on the thickness (basis weight) and the number of the sheets. As the thickness (basis weight) and the number of the sheets get larger, more torque will be required for moving the additional folding roller unit 260.

Figure 38:
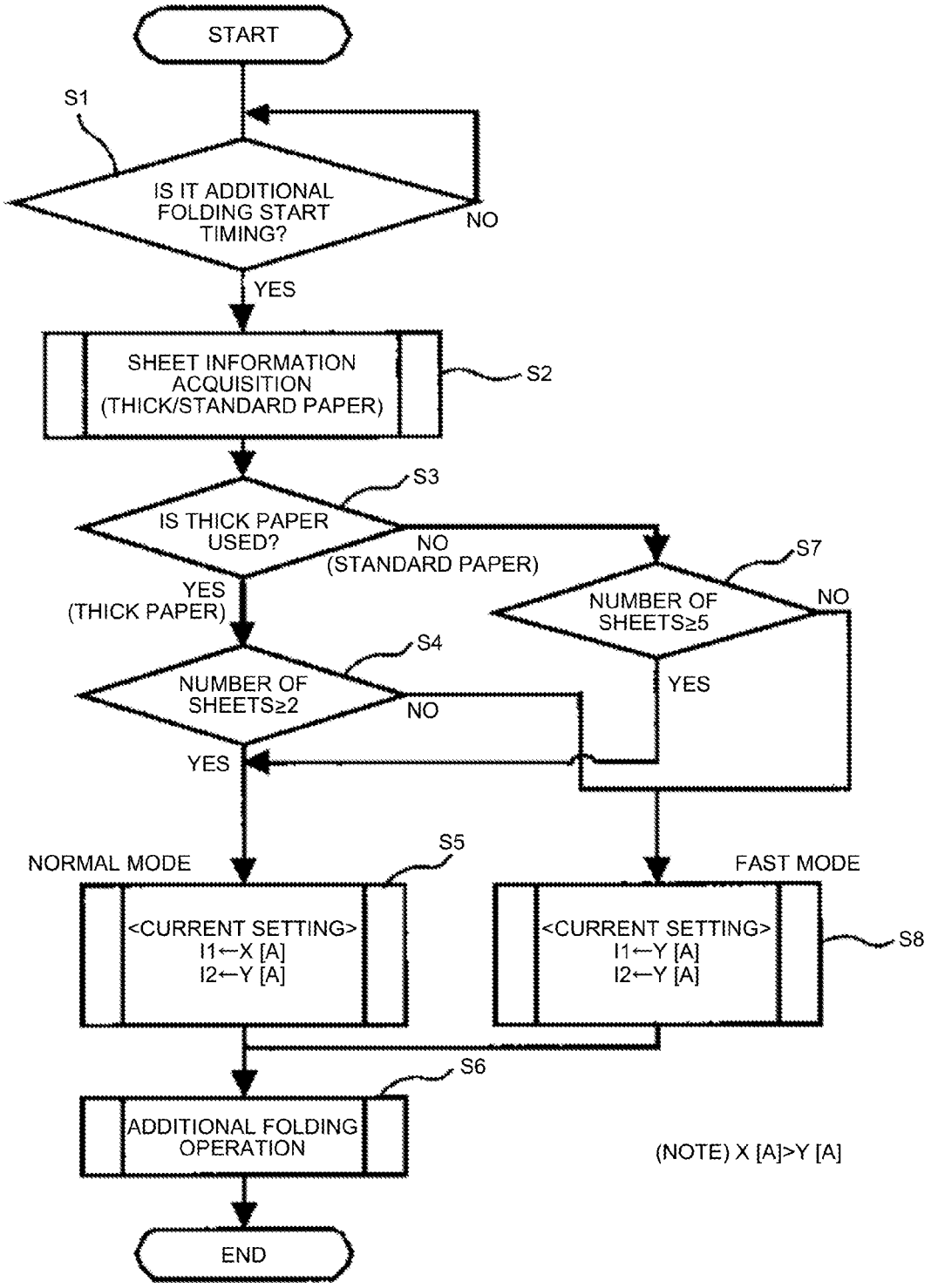
FIG. 38 is a flowchart illustrating an example of changing motor current settings based on conditions such as the thickness (basis weight) and the number of sheets.
Figure 39:
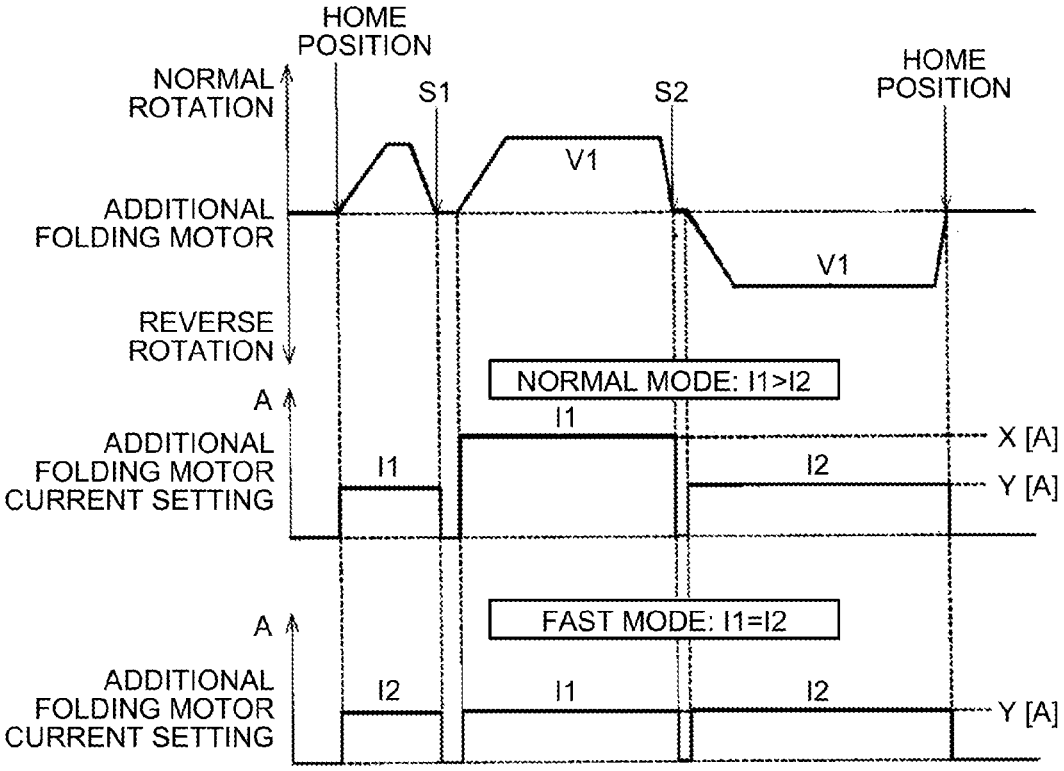
FIG. 39 is a timing chart for explaining changes in the motor current settings based on the movement direction of the additional folding roller unit between a normal mode and an energy-saving mode.

FIG. 38 is a flowchart illustrating an example of changing motor current settings based on conditions such as the thickness (basis weight) and the number of the sheets. FIG. 39 is a timing chart for explaining changes in the motor current settings based on the movement direction of the additional folding roller unit 260 between a normal mode and an energy-saving mode.

The CPU 311 illustrated in FIG. 36 acquires information of the sheets used at the timing of the additional folding start (Yes at Step S1) from the apparatus body (Step S2).

In this example, if the sheets are thick paper (Yes at Step S3) and the number of sheets contained in the sheet bundle SB is two or more (Yes at Step S4), the moving load of the additional folding roller unit 260 is high. If the sheets are standard paper (No at Step S3) and the number of sheets contained in the sheet bundle SB is five or more (Yes at Step S7), the moving load of the additional folding roller unit 260 is similarly high. For the cases described above, the motor current setting is performed in the normal mode. Specifically, I1=X [A], I2=Y [A], (X>Y) is specified in the motor current setting for the normal mode (Step S5).

It should be noted that the motor current I1 in the moving direction in which the load is high is set to the high current X [A], and the motor current I2 in the moving direction in which the load is low is set to the current Y [A] lower than the motor current I1.

On the contrary, if the sheets are thick paper and the number of sheets contained in the sheet bundle SB is one (No at Step S4) and if the sheets are standard paper and the number of sheets contained in the sheet bundle SB is four or less (No at Step S7), the load influence of the sheet bundle SB is decreased. In such cases, the motor current setting is performed in the energy-saving mode. Specifically, I1=Y [A], I2=Y [A] is specified in the motor current setting for the energy-saving mode (S8).

It should be noted that the currents are set to Y [A] that is the lower current for both movement directions. With this, the energy-saving performance can be improved.

After the motor current setting is performed either in the normal mode or in the energy-saving mode as described above, the additional folding operation is performed by the additional folding roller unit 260 (Step S6), whereby the control in series is completed.

Furthermore, when changing the operation mode either to the normal mode or the energy-saving mode based on a predetermined condition of this sheet information, the permission for the change can be set by the user optionally.

Figure 40:
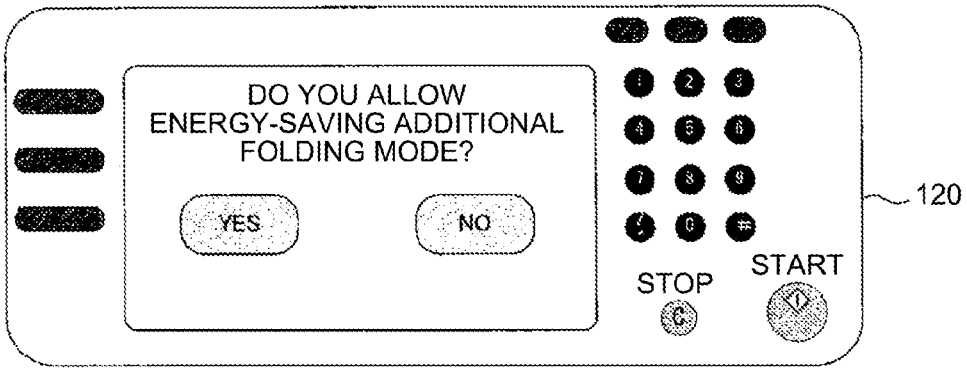
FIG. 40 is an explanatory diagram illustrating selection made by a user on whether or not to allow an energy-saving additional folding mode on an operation panel of the image forming apparatus.

For example, an operation panel 120 of the image forming apparatus 3, to which the saddle-stitching bookbinding apparatus 2 is connected, may be used for selecting between the normal mode and the energy-saving mode by the user selecting whether to allow the energy-saving additional folding mode, as illustrated in FIG. 40. The information selected on the operation panel 120 is then transmitted from a controller (not illustrated) in the image forming apparatus 3 to a controller 310 in the saddle-stitching bookbinding apparatus 2 through serial communication, determining if the CPU 311 changes the operation mode.

In the description above of the first configuration example and the second configuration example, the information serving as the condition for changing the operation modes depends on the sheet thickness (thick/standard paper) and the predetermined number of the sheets specified in advance. However, there may some cases depending on the user where additional folding processing in the fast mode or in the energy-saving mode cannot be performed under the predetermined condition even if the load condition is specified such that the fast mode or the energy-saving mode can be used for the processing in accordance with the sheet type that the user usually uses.

Figure 41:
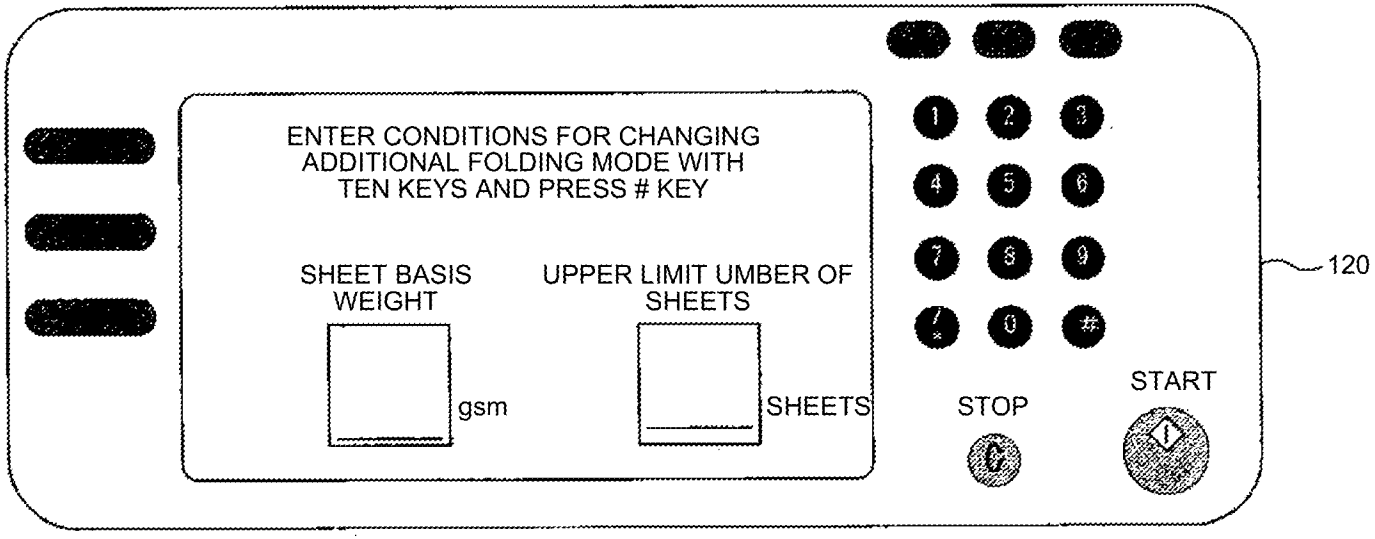
FIG. 41 is an explanatory diagram illustrating optional change made by a user in operation mode setting conditions on the operation panel of the image forming apparatus.

To solve this problem, it is configured that the operation panel 120 of the image forming apparatus 3, to which the saddle-stitching bookbinding apparatus 2 is connected, can be used for the user to optionally change the condition, as illustrated in FIG. 41. This configuration enables setting of the operation mode in a way more suitable for the actual use.

The description above is merely an example, and the present invention produces unique effects for each of the following aspects.

(Aspect A)

A sheet processing apparatus such as a saddle-stitching bookbinding apparatus 2 includes a pressurizing unit such as a pair of additional folding rollers that pressurizes a fold line portion of a sheet bundle in a sandwiching manner between a first pressurizing member such as an upper additional folding roller 261*a* and a second pressurizing member such as a lower additional folding roller 262*a*, and a moving unit such as a unit moving mechanism 263 that moves the pressurizing unit in the direction of the fold line of the sheet bundle, and includes at least a driving motor such as additional folding motors 314, 318. The position where the sheet bundle is pressurized by the first pressurizing member and the position where the sheet bundle is pressurized by the second pressurizing member are shifted in the direction of the fold line of the sheet bundle. The driving condition of the driving motor is changed between a first orientation such as the direction of normal rotational movement in which the pressurizing unit moves in the positional relation that the first pressurizing member precedes the second pressurizing member and a second orientation such as the direction of reverse rotational movement in which the pressurizing member moves in the positional relation that the second pressurizing member precedes the first pressurizing member. With this configuration, various problems can be solved that can be generated when using a pressurizing unit including a first pressurizing member and a second pressurizing member disposed in a manner shifted in the direction of the fold line of the sheet bundle, as described in the embodiment above.

(Aspect B)

When the moving speed of the pressurizing unit in the first orientation is assumed as V1 and the moving speed of the pressurizing unit in the second orientation is assumed as V2 in Aspect A, the driving condition of the driving motor is changed such that the relation in which $V1<V2$ is satisfied. This can prevent lowering of productivity of sheet bundles as described in the embodiment above.

(Aspect C)

When the set motor current of the driving motor in the first orientation is assumed as I1 and the set motor current of the driving motor in the second orientation is assumed as I2 in Aspect A, the driving condition of the driving motor is changed such that the relation in which $I1>I2$ is satisfied. This can improve energy-saving performance as described in the embodiment above.

(Aspect D)

In Aspect B, when a first speed set value X and a second speed set value Y that are set values of the moving speed of the pressurizing unit satisfy the relation in which $X<Y$, a first operation mode such as a normal mode satisfying the relation in which $V1=X$ and $V2=Y$ and a second operation mode such as a fast mode satisfying the relation in which $V1=Y$ and $V2=Y$ are available, and a sheet information acquiring unit such as a CPU 311 that acquires sheet information is provided, the first operation mode is executed if the sheet information satisfies a predetermined condition and the second operation mode is executed if the sheet information does not satisfy the predetermined condition. With this configuration, an additional folding unit can be moved at an optimal speed in accordance with conditions such as the thickness (basis weight) and the number of the sheets, as described in the embodiment above.

(Aspect E)

In Aspect C, when a first current set value X and a second current set value Y that are set values of the motor current of the driving motor satisfy the relation in which $X>Y$, a first operation mode such as a normal mode satisfying the relation in which $I1=X$ and $I2=Y$ and a second operation mode such as an energy-saving mode satisfying the relation in which $I1=Y$ and $I2=Y$ are available, and a sheet information acquiring unit such as a CPU 311 that acquires sheet information is provided, the first operation mode is executed if the sheet information satisfies a predetermined condition and the second operation mode is executed if the sheet information does not satisfy the predetermined condition. With this configuration, an additional folding unit can be moved at an optimal current in accordance with conditions such as the thickness (basis weight) and the number of the sheets, as described in the embodiment above.

(Aspect F)

In Aspect D or Aspect E, a second-operation-mode propriety setting unit such as an operation panel 120 is provided that allows a user to optionally set the propriety of selection of the second operation mode. With this configuration, additional folding can be performed in the operation mode that the user desires, as described in the embodiment above.

(Aspect G)

In Aspect D, Aspect E, or Aspect F, a sheet information condition setting unit such as an operation panel 120 is provided that allows a user to optionally set a predetermined condition of the sheet information used for changing between the first operation mode and the second operation mode. This configuration enables setting of the operation mode in a way more suitable for the actual use, as described in the embodiment above.

(Aspect H)

In Aspect A, Aspect B, Aspect C, Aspect D, Aspect E, Aspect F, or Aspect G, when it is assumed that an tangential direction of the first pressurizing member and the second pressurizing member is indicated by the tangential line at the touch point between the first pressurizing member and the second pressurizing member, and the angle of the line segment of the tangential direction formed from the line segment of the sheet thickness direction is indicated as $\theta$, the angle $\theta$ satisfies $0[°]<\theta<90[°]$.

(Aspect I)

In Aspect A, Aspect B, Aspect C, Aspect D, Aspect E, Aspect F, Aspect G, or Aspect H, the pressurizing unit performs pressurization on the fold line portion of the sheet bundle from a predetermined position within the sheet width to one end in the direction of the fold line of the sheet bundle and then performs pressurization on the part of the fold line portion not pressurized in the prior pressurization operation while moving back in the direction of the fold line of the sheet bundle. This configuration can prevent any damage generated on the ends of the sheet bundle while the fold line portion of the sheet bundle is additionally folded, and control generation of turning-up and crinkling on and in the vicinity of the fold line portion due to accumulation of kinking, as described in the embodiment above.

(Aspect J)

In an image forming system such as an image forming system 4 including an image forming apparatus such as an image forming apparatus 3 that forms an image on a sheet and a sheet processing apparatus such as a saddle-stitching bookbinding apparatus 2 that performs folding processing on the sheet with the image formed by the image forming apparatus thereon, the sheet processing apparatus in Aspect A, Aspect B, Aspect C, Aspect D, Aspect E, Aspect F, Aspect G, Aspect H, or Aspect I is used as the sheet processing apparatus. With this configuration, productivity of additionally folded sheet bundles and energy-saving performance can be improved, as described in the embodiment above.

In embodiments of the present invention, when the pressurizing unit is moved in the sheet width direction to pressurize the fold of the sheet bundle, the driving condition of the driving motor is changed between the first orientation and the second orientation in which the magnitude of the load applied to the driving motor is different from each other. With this, when the pressurizing unit pressurizes the fold line portion of the sheet bundle, the condition that is the most suitable for the load applied to the driving motor can be used for driving the driving motor. Various problems, such as lowering of productivity of sheet bundles on which pressurization has been performed by the pressurizing unit and difficulties in energy-saving efforts, can be thus controlled, which could have been generated when the pressurizing unit is moved in the direction of the fold line of the sheet bundle in the case where the driving condition of the driving motor is the same in both the first orientation and the second orientation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a pressurizing unit configured to pressurize a fold line portion of a sheet bundle in a sandwiching manner between a first pressurizing member and a second pressurizing member; and a moving unit configured to move the pressurizing unit in the direction of the fold line of the sheet bundle, the moving unit including at least a driving motor, wherein:

the position where the sheet bundle is pressurized by the first pressurizing member and the position where the sheet bundle is pressurized by the second pressurizing member are shifted in the direction of the fold line of the sheet bundle, a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member, and when the motor current flowing in the driving motor in the first orientation is assumed as I1 and the motor current flowing in the driving motor in the second orientation is assumed as I2, the driving condition of the driving motor is changed such that the relation in which I1>I2 is satisfied.

2. The sheet processing apparatus according to claim 1, wherein when the moving speed of the pressurizing unit in the first orientation is assumed as V1 and the moving speed of the pressurizing unit in the second orientation is assumed as V2, the driving condition of the driving motor is changed such that the relation in which V1<V2 is satisfied.

3. The sheet processing apparatus according to claim 2, further comprising:

a sheet information acquiring unit configured to acquire sheet information, wherein a first speed set value X and a second speed set value Y as set values of the moving speed of the pressurizing unit satisfy the relation in which X<Y, a first operation mode satisfying the relation in which V1=X and V2=Y and a second operation mode satisfying the relation in which V1=Y and V2=Y are available, and the first operation mode is executed when the sheet information satisfies a predetermined condition and the second operation mode is executed when the sheet information does not satisfy the predetermined condition.

4. The sheet processing apparatus according to claim 3, further comprising a second-operation-mode propriety setting unit configured to allow a user to optionally set propriety of selection of the second operation mode.

5. The sheet processing apparatus according to claim 3, further comprising a sheet information condition setting unit configured to allow a user to optionally set a predetermined condition of the sheet information used for changing between the first operation mode and the second operation mode.

6. The sheet processing apparatus according to claim 1, further comprising:

a sheet information acquiring unit configured to acquire sheet information, wherein a first current set value X and a second current set value Y as set values of the motor current of the driving motor satisfy the relation in which X>Y, a first operation mode satisfying the relation in which I1=X and I2=Y and a second operation mode satisfying the relation in which I1=Y and I2=Y are available, and the first operation mode is executed when the sheet information satisfies a predetermined condition and the second operation mode is executed when the sheet information does not satisfy the predetermined condition.

7. The sheet processing apparatus according to claim 6, further comprising a second-operation-mode propriety setting unit configured to allow a user to optionally set propriety of selection of the second operation mode.

8. The sheet processing apparatus according to claim 6, further comprising a sheet information condition setting unit configured to allow a user to optionally set a predetermined condition of the sheet information used for changing between the first operation mode and the second operation mode.

9. The sheet processing apparatus according to claim 1, wherein when it is assumed that an tangential direction of the first pressurizing member and the second pressurizing member is indicated by the tangential line at the touch point between the first pressurizing member and the second pressurizing member, and the angle of the line segment of the tangential direction formed from the line segment of the sheet thickness direction is indicated as θ, the angle θsatisfies 0[°]<θ<90[°].

10. The sheet processing apparatus according to claim 1, wherein the pressurizing unit performs pressurization on the fold line portion of the sheet bundle from a predetermined position within the sheet width to one end in the direction of the fold line of the sheet bundle and then performs pressurization on the part of the fold line portion not pressurized in the prior pressurization operation while moving back in the direction of the fold line of the sheet bundle.

11. An image forming system, comprising:

an image forming apparatus configured to form an image on a sheet; and a sheet processing apparatus configured to perform folding processing on the sheet with the image formed by the image forming apparatus thereon, wherein the sheet processing apparatus includes:

a pressurizing unit configured to pressurize a fold line portion of a sheet bundle in a sandwiching manner between a first pressurizing member and a second pressurizing member; and a moving unit configured to move the pressurizing unit in the direction of the fold line of the sheet bundle, the moving unit including at least a driving motor, wherein the position where the sheet bundle is pressurized by the first pressurizing member and the position where the sheet bundle is pressurized by the second pressurizing member are shifted in the direction of the fold line of the sheet bundle, a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member, and when the motor current flowing in the driving motor in the first orientation is assumed as I1 and the motor current flowing in the driving motor in the second orientation is assumed as I2, the driving condition of the driving motor is changed such that the relation in which I1>I2 is satisfied.

12. A sheet processing apparatus, comprising:

a pressurizing unit configured to pressurize a fold line portion of a sheet bundle in a sandwiching manner between a first pressurizing member and a second pressurizing member;

a moving unit configured to move the pressurizing unit in the direction of the fold line of the sheet bundle, the moving unit including at least a driving motor, wherein the position where the sheet bundle is pressurized by the first pressurizing member and the position where the sheet bundle is pressurized by the second pressurizing member are shifted in the direction of the fold line of the sheet bundle, a driving condition of the driving motor is changed between a first orientation in which the pressurizing unit moves in the positional relation that the first pressurizing member precedes the second pressurizing member and a second orientation in which the pressurizing member moves in the positional relation that the second pressurizing member precedes the first pressurizing member, and when the moving speed of the pressurizing unit in the first orientation is assumed as V1 and the moving speed of the pressurizing unit in the second orientation is assumed as V2, the driving condition of the driving motor is changed such that the relation in which V1<V2 is satisfied; and a sheet information acquiring unit configured to acquire sheet information, wherein a first speed set value X and a second speed set value Y as set values of the moving speed of the pressurizing unit satisfy the relation in which X<Y, a first operation mode satisfying the relation in which V1=X and V2=Y and a second operation mode satisfying the relation in which V1=Y and V2=Y are available, and the first operation mode is executed when the sheet information satisfies a predetermined condition and the second operation mode is executed when the sheet information does not satisfy the predetermined condition.

* * * * *